US005669360A

United States Patent [19]

Hyodo et al.

[11] Patent Number: 5,669,360

[45] Date of Patent: Sep. 23, 1997

[54] FUEL-VAPOR EMISSION-CONTROL SYSTEM FOR CONTROLLING THE PRESSURE IN A SYSTEM

[75] Inventors: Yoshihiko Hyodo; Hiroki Matsuoka, both of Susono; Takashi Ishikawa, Okazaki, all of Japan

[73] Assignee: Toyota Jidosha Kabushiki Kaisha, Aichi, Japan

[21] Appl. No.: 601,639

[22] Filed: Feb. 14, 1996

[30] Foreign Application Priority Data

Feb. 17, 1995 [JP] Japan ..... 7-029624

[51] Int. Cl.[6] ..... F02M 37/04

[52] U.S. Cl. ..... 123/520; 123/198 D

[58] Field of Search ..... 123/520, 521, 123/516, 518, 519, 198 D

[56] References Cited

U.S. PATENT DOCUMENTS

| | | | |
|---|---|---|---|
| 4,862,856 | 9/1989 | Yokoe | 123/520 |
| 5,174,265 | 12/1992 | Sekive | 123/520 |
| 5,193,512 | 3/1993 | Steinbrenner | 123/520 |
| 5,209,210 | 5/1993 | Ikeda | 123/520 |
| 5,245,975 | 9/1993 | Ito | 123/520 |
| 5,253,629 | 10/1993 | Fornuto | 123/519 |
| 5,273,020 | 12/1993 | Hayami | 123/520 |
| 5,347,971 | 9/1994 | Robayashi | 123/520 |
| 5,363,828 | 11/1994 | Yamashita | 123/520 |
| 5,442,551 | 8/1995 | Denz | 123/520 |

FOREIGN PATENT DOCUMENTS

| | | | |
|---|---|---|---|
| 4132868 | 5/1992 | Japan | 123/519 |
| 62-80693 | 10/1994 | Japan | 123/519 |

*Primary Examiner*—Carl S. Miller
*Attorney, Agent, or Firm*—Kenyon & Kenyon

[57] ABSTRACT

A fuel-vapor emission-control system for an internal combustion engine which is capable of achieving both a reduction of the exhaust of vapor into the atmosphere and the prevention of an excessive increase in pressure within the fuel tank, regardless of the amount of internal pressure in the fuel tank, by providing on an atmospheric release port of the canister which adsorbs vapor adsorbed from the fuel tank of the internal combustion engine, thereby preventing release of the vapor into the atmosphere, an atmospheric release surface area changing valve which changes the surface area of an aperture to the atmosphere. The atmospheric release surface area valve operates to make the atmospheric release surface area larger when the internal pressure in the fuel tank is large than when the internal pressure in the fuel tank is small. The atmospheric release surface area changing valve can be configured as a mechanical type of pressure-sensitive valve which opens when the internal pressure in the canister exceeds a set value, and can also be configured as an electromagnetic valve, the degree of opening of which can be electrically varied in response to a detected value of vapor pressure within the system to thereby change the atmospheric release surface area.

11 Claims, 16 Drawing Sheets

FUEL-VAPOR EMISSION-CONTROL SYSTEM FOR CONTROLLING THE PRESSURE IN A SYSTEM

BACKGROUND OF THE INVENTION

1. Field of the Invention

The present invention relates to a fuel-vapor emission-control system for an internal combustion engine, and more specifically to a fuel-vapor emission control system for an internal combustion engine which is capable of proper adsorption of vaporized fuel within a charcoal canister and the prevention of a rise of the pressure within the system, without regard to the amount of fuel vaporized from the fuel tank of the vehicle.

2. Description of the Related Art

In general, in an internal combustion engine, a fuel-vapor emission control system is provided so that fuel does escape into the atmosphere from the fuel tank, the carburetor or any other place where fuel is accumulated when the engine is stopped. This fuel-vapor emission-control system causes vapor (a gas mixture of fuel vapor and air) which flows from the parts in which fuel is accumulated to be adsorbed in a canister, air being released into the atmosphere and the fuel vapor which is adsorbed in the canister being purged, using the negative pressure of the engine during running, to the intake side. In such a canister, to prevent the escape of fuel vapor into the atmosphere when the vehicle is stopped, due to vapor concentration dispersion caused by the temperature difference after running the vehicle, the canister is generally provided with a diaphragm on the atmospheric release port. In addition, in a split canister having a main canister and a sub-canister, there is generally a diaphragm in the path therebetween.

However, the amount of fuel vaporized from a fuel tank differs depending upon the operating condition of the vehicle in which the fuel tank is mounted, the air temperature, refueling state, and the like. When refueling is done, because of the agitation of the fuel in the fuel tank which is caused by the fuel supplied by the refueling gun, there is an extremely large amount of vapor generated, as well as a high pressure within the fuel tank. Under these conditions, when vapor generated in the fuel tank is sent to the canister, because of a diaphragm in the canister, the resistance to the flow of the vapor becomes large, and there is an increase in the pressure within the canister and fuel tank.

SUMMARY OF THE INVENTION

To solve the above-noted problem in a fuel-vapor emission-control system for an internal combustion engine, an object of the present invention is to provide a fuel-vapor emission-control system for an internal combustion engine which, by controlling the amount of vapor flow in a canister, is capable of achieving both a reduction of the exhaust of vapor into the atmosphere and the prevention of an excessive increase in pressure within the fuel tank.

The present invention is a fuel-vapor emission-control system for an internal combustion engine, in which fuel vapor which is generated in a fuel tank is adsorbed in a canister so that it is not released into the atmosphere and further in which vaporized fuel which is adsorbed during operation of the engine is returned to the intake manifold of the engine, this fuel-vapor emission-control system being provided with a tank port into which vapor flows from the fuel tank, a purge port from which vapor is exhausted to the intake manifold, and an atmospheric port which is connected through to the atmosphere, a canister, within which is included adsorbing material, being provided between the tank port, the purge port, and the atmospheric port, an atmospheric release surface area control means which varies the atmospheric release surface area of the canister being provided at a prescribed position on the atmospheric side of the canister, this atmospheric release surface area control means operating so as to make the atmospheric release surface area large when the pressure within the fuel tank is large, in comparison to when the pressure within the fuel tank is small.

The atmospheric release surface area changing means can be a pressure-sensitive valve which opens when the pressure, on the fuel tank side, within the canister exceeds a prescribed value, and can also have a configuration formed by an electromagnetic valve which varies the atmospheric release surface area in accordance with the amount of valve opening, and a control means for controlling the opening degree of this electromagnetic valve.

In the case in which the atmospheric release surface area changing means is configured by a pressure-sensitive valve, the pressure-sensitive valve can be mounted to a second atmospheric port which is provided on the canister. The pressure-sensitive valve has a diaphragm and a diaphragm chamber which is sealed-off thereby, the other end of second atmospheric port, one end of which is open to the atmosphere, being sealed by the above-noted diaphragm when the pressure within the canister is low, this other end of the second atmospheric port being made the diaphragm valve which opens when the pressure within the canister rises, so that the diaphragm moves in the direction of the diaphragm chamber. It is also possible further to connect to the end of the pressure-sensitive valve open to the atmosphere a buffer canister of small capacity and which has a third atmospheric port. In addition, the pressure-sensitive valve can be configured so as to have an inclined plate which is mounted at an inclination with respect to the ground, a through hole being provided in this inclined plate, and a valve body, one end of which is supported at the top part of the through hold, this valve body covering and sealing by its weight the above-noted through hole when the pressure within the canister is low.

In the case in which the atmospheric release surface area changing means is an electromagnetic valve and a control means therefor, if a refueling detecting means which senses refueling of the fuel tank is connected to this control means, it is possible for the control means to make the degree of opening of the electromagnetic valve large during refueling. In addition to this, in the case in which the electromagnetic valve is configured so as to have a prescribed degree of opening when it is not energized, it is possible for the control means to have the electromagnetic valve not energized when both the engine is stopped and refueling is not being done.

In addition, in the case in which an internal pressure detecting sensor which detects the pressure within the fuel tank is connected to the control means, it is possible for the control means, in response to the detected value of internal pressure within the fuel tank, both to perform feedback control of the electromagnetic valve so that internal pressure is controlled to a prescribed value and, when refueling of the fuel tank is sensed, to control the electromagnetic valve so that the degree of opening of the electromagnetic valve is a prescribed value.

It is possible to use an electrical purge flow control valve, the degree of opening of which varies in response to duty-cycle control, as the electromagnetic valve. A buffer canister having a small working capacity can be connected to the atmospheric side of the electromagnetic valve. In addition, the electromagnetic valve can be configured so that it maintains a prescribed degree of opening A when it is not energized, and for the control means to not energize the electromagnetic valve when both the engine is stopped and refueling is not being done.

According to a fuel-vapor emission-control system for an internal combustion engine in accordance with the present invention, in the case in which the purge concentration within the fuel tank is low, because the atmospheric release surface area is made small by the atmospheric release surface area changing means provided in the canister, vapor from the fuel tank is adsorbed by the adsorbing material within the canister. However, when the vapor concentration in the fuel tank is high and the internal pressure within the fuel tank increases, because the atmospheric release surface area is made large by the atmospheric release surface area changing means, a large amount of vapor from the fuel tank blows out of the canister and fuel-vapor in the vapor is adsorbed in the canister, without resulting in an increase in the pressure differential between before and after the adsorbing material within the canister. As a result, the pressure within the fuel tank is properly maintained, and the amount of vaporized fuel released to the atmosphere is reduced.

According to a fuel-vapor emission-control system for an internal combustion engine in accordance with the present invention, in the case in which the vapor concentration within the fuel tank is low, because the atmospheric release surface area of the canister is kept small, it is possible to limit the amount of vaporized fuel which is released into the atmosphere, and in the case in which the vapor concentration within the fuel tank is high, the atmospheric release surface area of the canister is made large, so that it is possible for a large amount of vaporized fuel contained in the vapor to be adsorbed in the canister, without resulting in an increase in the pressure differential between before and after the adsorbing material within the canister, enabling both a reduction of the exhaust of vapor into the atmosphere and the prevention of a rise of the pressure within the fuel tank.

BRIEF DESCRIPTION OF THE DRAWINGS

The present invention will be more clearly understood from the description as set forth below, with reference being made to the accompanying drawings, wherein.

DESCRIPTION OF THE PREFERRED EMBODIMENTS

Embodiments of the present invention will be described in detail below, with reference to the accompanying drawings.

The embodiments of the present invention represent a first aspect and a second aspect of the present invention. In the first aspect of a fuel-vapor emission-control system 20 for an internal combustion engine, the atmospheric-side release surface area of the canister is mechanically controlled, by the pressure of the vapor only. In the second aspect of a fuel-vapor emission-control system 30 for an internal combustion engine, the atmospheric-side release surface area of the canister is electrically controlled.

Figure 1:
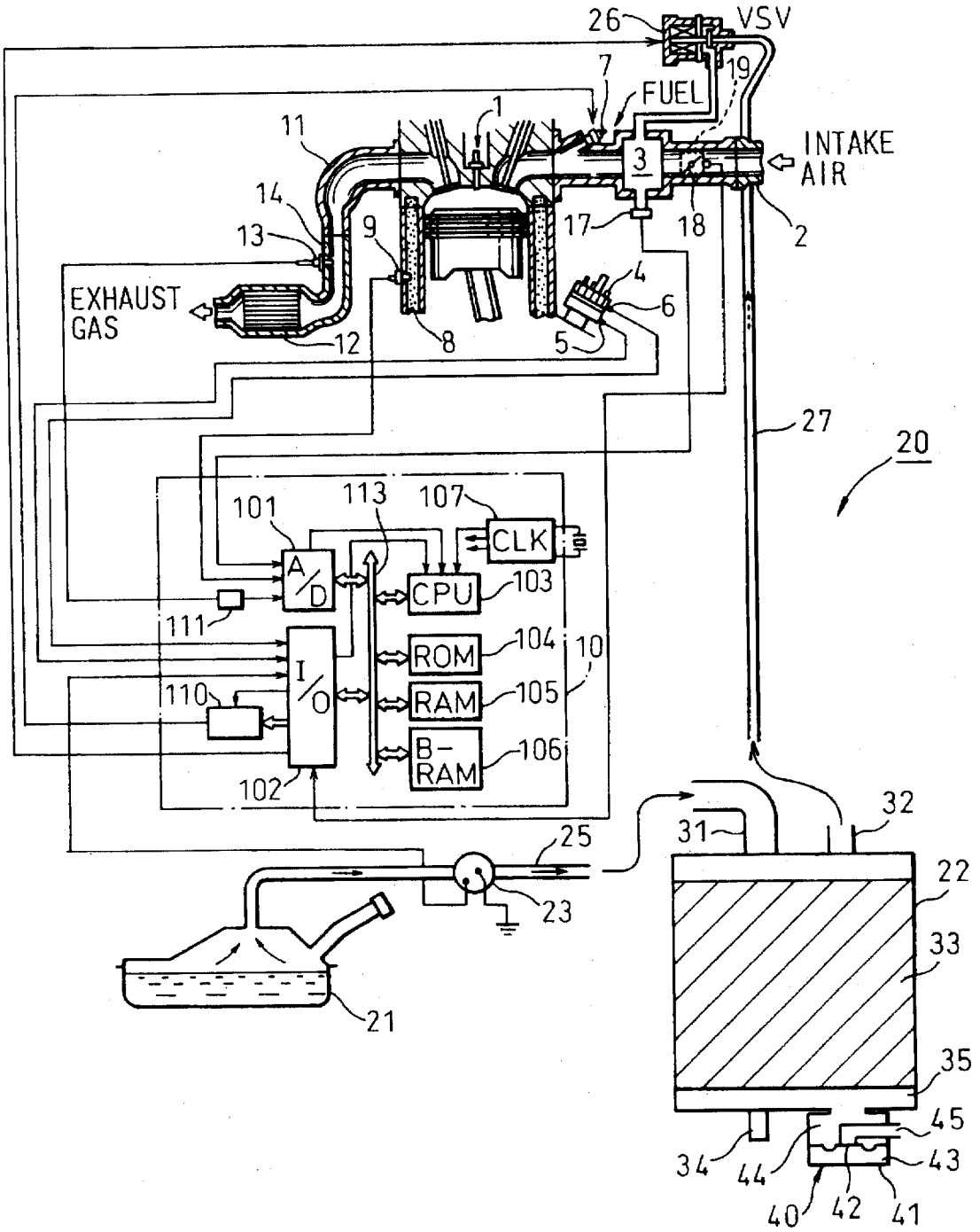
FIG. 1 is a drawing which shows the overall configuration of the first embodiment of fuel-vapor emission-control system for an internal combustion engine according to the present invention, along with an internal combustion engine.

FIG. 1 shows the configuration of the first embodiment of the present invention, this drawing showing, in simplified form, an electronically controlled internal combustion engine 1 which is provided with a fuel-vapor emission-control system 20 of the first aspect of the present invention.

In FIG. 1, the reference numeral 1 denotes an internal combustion engine, 2 is an intake manifold, 3 is a surge tank, 4 is a distributor, 5 and 6 are crank angle sensors, 7 is a fuel injection valve, 8 is a cooling water path, 9 is a water temperature sensor, 10 is a control circuit, 11 is an exhaust manifold, 12 is a catalytic converter, 13 is an $O_2$ sensor, 14 is an exhaust pipe, 17 is a pressure sensor, 18 is a throttle valve, and 19 is a throttle degree of opening sensor.

The throttle valve 18 is provided in the intake manifold 2 of the internal combustion engine 1. The throttle degree of opening sensor 19, which detects the degree of opening of the throttle valve 18, is provided on the shaft of the throttle valve 18, the surge tank 3 is provide in the manifold, downstream from the throttle degree of opening sensor 19, and the pressure sensor 17, which detects the intake pressure, is provided within the surge tank 3. The fuel injection valve 7, for the purpose of supplying pressurized fuel from the fuel supply system to the intake port of each cylinder, is provided downstream from the surge tank 3.

The distributor 4 is provided with a crank angle sensor 5, which generates a reference position detection pulse signal each, for example, 720° of crank angle (CA) movement, and a crank angle sensor 6, which generates a reference position detection pulse signal each 30° of crank angle (CA) movement. The pulse signals from these crank angle sensors 5, 6 serve as, for example, the fuel injection timing interrupt request signal, the spark timing reference timing signal, and fuel injection amount calculation control interrupt request signal. These signals are supplied to an input/output interface 102 of the control circuit 10, and of these signals, the output of the crank angle sensor 6 is supplied to an interrupt terminal of a CPU 103.

The water temperature sensor 9 for the purpose of detecting the temperature of the cooling water is provided in the cooling water path 8 of the cylinder block of the internal combustion engine 1, and generates an analog voltage electrical signal responsive to the temperature of the cooling water, THW. This output is supplied to an A/D converter 101 of the control circuit 10.

The three-way catalytic converter 12, which cleanses three harmful components of the exhaust gas, vaporized fuel, CO, and NOx, is provided in the exhaust system, downstream from the exhaust manifold 11. Downstream from the exhaust manifold 11, on the exhaust pipe 14 downstream from the catalytic converter 12, is provided the $O_2$ sensor 13, which is a type of air-fuel ratio sensor. The $O_2$ sensor 13 generates an electrical signal which is responsive to the concentration of oxygen in the exhaust gas. That is, the $O_2$ sensor 13 supplies, via a signal processing circuit 111 of the control circuit 10, voltages which differ, responsive to the rich condition and the lean condition of air-fuel ratio with respect to the theoretical air-fuel ratio. The input/output interface 102 is supplied with an on/off signal of a key switch (not shown in the drawing).

The control circuit 10 is implemented by, for example, a microcomputer and, in addition to the above-noted A/D converter 101, input/output interface 102, CPU 103, and signal processing circuit 111, it is provided with a ROM 104, a RAM 105, a buffer RAM 106 which holds information even after the key switch is set to off, a clock (CLK) 107, and so on, these being mutually connected via a bus 113. In this control circuit 10, an injection control circuit 110, which includes a down-counter, and up-counter, and a drive circuit, is provided for the purpose of controlling the fuel injection valve 7.

The fuel-vapor emission-control system 20, which prevents the escape of vaporized fuel from the fuel tank 21 to the atmosphere, has a charcoal canister 22 and an electrical purge flow amount control valve (VSV) 26. The charcoal canister 22 is joined to the bottom of the fuel tank 21 by means of a vapor delivery pipe 25, and adsorbs vapor generated from the fuel tank 21. This vapor delivery pipe 25 has midway in it a tank internal pressure control valve 23 which opens when the vapor pressure within the fuel tank 21 exceeds a prescribed pressure. This internal pressure control valve 23 has mounted on it a switch, the open/closed state of this internal pressure control value 23 being input to the input/output interface 102. The VSV 26 is an electromagnetic valve which is provided midway in the vapor return pipe 27, which returns vapor adsorbed in the charcoal canister 22 to the downstream side of the throttle valve 18 of the intake manifold 2, this valve opening and closing in response to an electrical signal from the control circuit 10. This VSV 26 can provide duty-cycle control of the amount of vapor flowing into the intake manifold 2.

The canister 22 generally has a tank port 31 which connects to the vapor delivery pipe 25, a purge port 32 which connects to the vapor return pipe 27, activated charcoal 33 which adsorbs vapor, and an atmospheric port 35 having a large cross-sectional area. An atmospheric chamber 35 is formed between the atmospheric port 33 and the activated charcoal 33. In this embodiment, the atmospheric chamber 35 of the canister 22 has provided on it a flow control valve 40, separate from the atmospheric port 34.

The space within the housing 41 of the flow control valve 40 is divided by the diaphragm 42 into a diaphragm chamber 43 and a second atmospheric chamber 44. The diaphragm chamber 43 is sealed, and the second atmospheric chamber 44 is connected to the atmospheric chamber 35 of the canister 22. Inside the second atmospheric chamber 44 is provided a second atmospheric port 45. One end of this second atmospheric port 45 is open to the atmosphere, the other end being sealed by the diaphragm 42. Therefore, the second atmospheric port 45 usually does not open the second atmospheric chamber 44 to the atmosphere, and only when the diaphragm 42 moves in the direction of the diaphragm chamber 43 is the second atmospheric chamber 44 opened to the atmosphere.

In a configuration such as described above, when a key switch (not shown in the drawing) is set to on, the control circuit 10 is energized and a program is started, whereupon outputs from various sensors are captured, and the fuel injection valve 7 and other actuators are controlled.

Next, the operation of the canister 22 in the fuel-vapor emission-control system 20 of the embodiment configured as described above will be described.

When fuel-vapor is generated in the fuel tank 21 and the pressure of the vapor (a mixture of fuel vapor and air)

increases, the vapor flowing out in the vapor delivery pipe 25, passing through the internal pressure control valve 23 and entering the canister 22 from the tank port 31, the fuel vapor being adsorbed by the activated charcoal 33, the pressure inside the atmospheric chamber 35 of the canister 22 rises. When the pressure inside the atmospheric chamber 35 increases, the pressure inside the second atmospheric chamber 44 also rises, this causing the diaphragm 42 to move in the direction of the diaphragm chamber 43. When this occurs, because the second atmospheric chamber 45 is connected to the atmosphere, the air inside the atmospheric chamber 35 of the canister 22 is released into the atmosphere via the second atmospheric port 45. As a result, the pressure within the atmospheric chamber 35 is reduced, so that the rise in pressure inside the atmospheric chamber 35 is eliminated.

Therefore, the pressure inside the fuel tank 21 can be limited to a prescribed value by adjusting the flow characteristics of the flow control valve of the canister 22.

Figure 2:
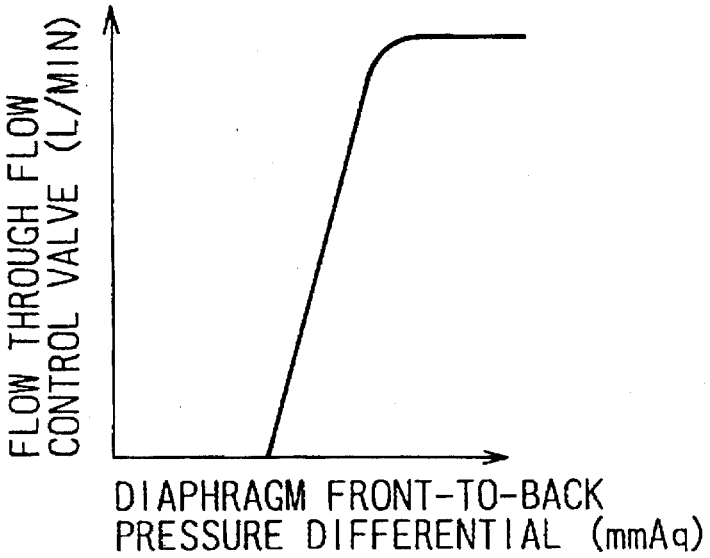
FIG. 2 is a graph which shows the relationship between the diaphragm front-to-back pressure differential of a flow control valve and the amount of flow through the flow control valve.

FIG. 2 shows the flow characteristics of the flow control valve 40 with respect to the diaphragm 42 front-to-back pressure differential. When the front-to-back pressure differential of the diaphragm 42 becomes large, that is, when the internal pressure within the fuel tank 21 becomes high, because the diaphragm 42 makes the degree of opening of the atmospheric port 45 larger, the amount of flow through the flow control valve 40 increases. Therefore, in the case in which the internal pressure within the fuel tank 21 rises, because the amount of flow through the flow control valve 40 is increased in response to this pressure, it is possible to limit the rise in internal pressure within the fuel tank 21.

Figure 3:
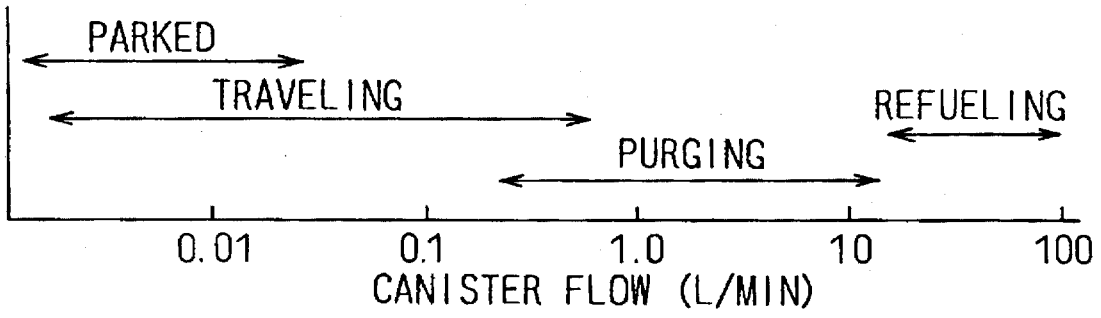
FIG. 3 is a drawing which illustrates the relationship between the vehicle operating condition and the amount of canister flow.

FIG. 3 shows a comparison of the amount of vapor flow in the canister 22 for various vehicle operating conditions. As can be seen from this drawing, the amount of vapor flowing in the canister 22 is largest when refueling, followed by during purging, with the vapor amount being small for the two conditions of parked and running. According to the fuel-vapor emission-control system 20 of the embodiment configured as described above, when the pressure in the fuel tank 21 increases during refueling, because the second atmospheric port 45 is opened to the atmosphere, it is possible for air to escape from both the canister 22 and the previously provided atmospheric port 34. As a result, in the fuel-vapor emission-control system 20 of the embodiment configured as described above, it is possible to cope with the increase in the flow of vapor in the canister 22.

Figure 4:
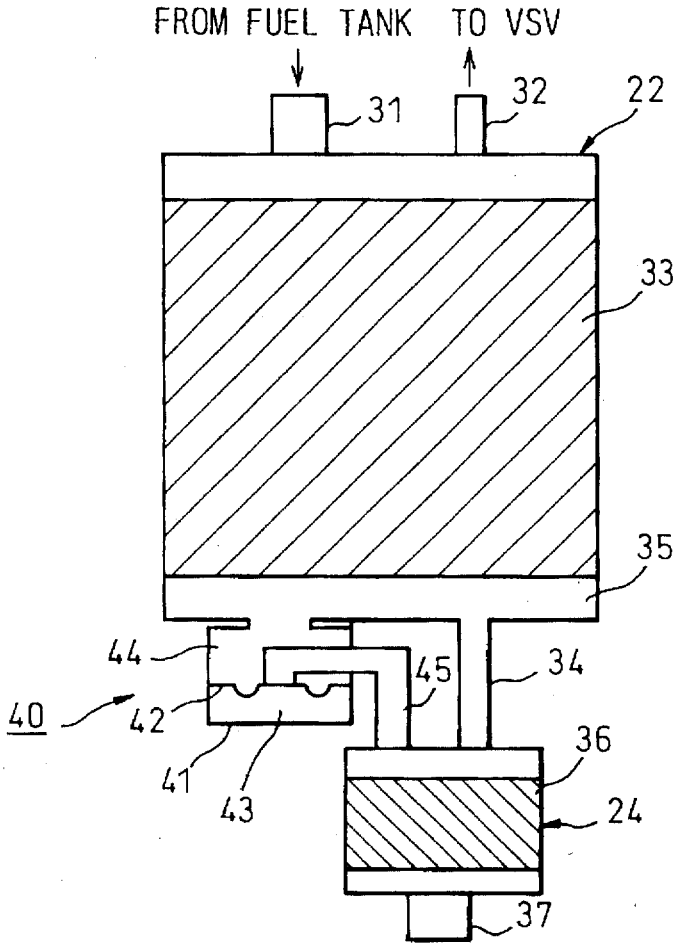
FIG. 4 is a cross-sectional view which shows the configuration of a canister which is used in the second embodiment of fuel-vapor emission-control system for an internal combustion engine according to the present invention.

FIG. 4 shows the configuration of the second embodiment of the present invention, in which the canister 22 used has a different configuration than that used in the first aspect of the fuel-vapor emission-control system 20. In this embodiment, elements of the canister 22 that are the same as in the first embodiment are assigned the same reference numerals, and are not explicitly described herein.

The canister 22 of the second embodiment differs from the canister 22 of the first embodiment in that a buffer canister 24 is connected downstream from the atmospheric chamber 34. For this reason, the second atmospheric port 45 provided on the flow control valve 40 in the first embodiment also is connected to the buffer canister 24. Activated charcoal 36 is provided inside the buffer canister 24 as well, a third atmospheric chamber 37, having a large cross-sectional area, being provided on the atmospheric side of the buffer canister 24.

In the canister 22 of the second embodiment, because of the constriction of the atmospheric port 34, the diffusion of vaporized fuel is small, and there is little leakage of vaporized fuel into the atmosphere. The diffusion of vapor within the activated charcoal 33 is extremely slow. The diffusion vapor in the activated charcoal 33 becomes a problem when the vehicle is stopped, at which time the amount of vapor flow is small, and there is little rise of pressure inside the fuel tank 21. Therefore, when the vehicle is stopped, the air from which vaporized fuel has been removed by the canister 22 enters the buffer canister 24 from the atmospheric port 34, and is released in to the atmosphere from the third atmospheric port 37. When the amount of vapor entering the canister 22 from the fuel tank 21 is great, such as when the vehicle is running, the pressure inside the atmospheric chamber 35 increases due to the flow resistance in the atmospheric port 34, this causing the diaphragm 42 of the flow control valve 40 to be pushed up. Under this condition, the air within the atmospheric chamber 35 enters the buffer canister 24 both from the atmospheric port 34 within the atmospheric chamber 35 and from the flow control valve 40, this air being released into the atmosphere from the third atmospheric port 37. As a result, the internal pressure in the atmospheric chamber 35 of the canister 22, that is, the pressure of the fuel tank 21, is reduced.

Figure 5:
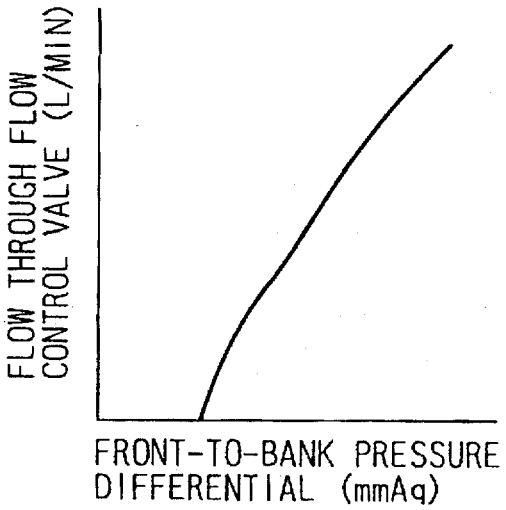
FIG. 5 is a graph which shows the relationship between the activated charcoal front-to-back pressure differential in the canister of FIG. 4 of a flow control valve and the amount of fuel vapor flow.

FIG. 5 shows the flow characteristics in the second embodiment with respect to the diaphragm 42 front-to-back pressure differential of the flow control valve 42. In this embodiment as well, when the diaphragm 42 front-to-back pressure differential becomes large, that is, when the internal pressure inside the fuel tank 21 becomes high, the amount of flow through the flow control valve becomes large. Therefore, it can be seen from this drawing that, in the case in which there is a rise in the internal pressure inside the fuel tank 21, because the amount of flow through the flow control valve 40 responsive to this pressure increases, it is possible to limit the rise of internal pressure inside the fuel tank 21.

Figure 6A:
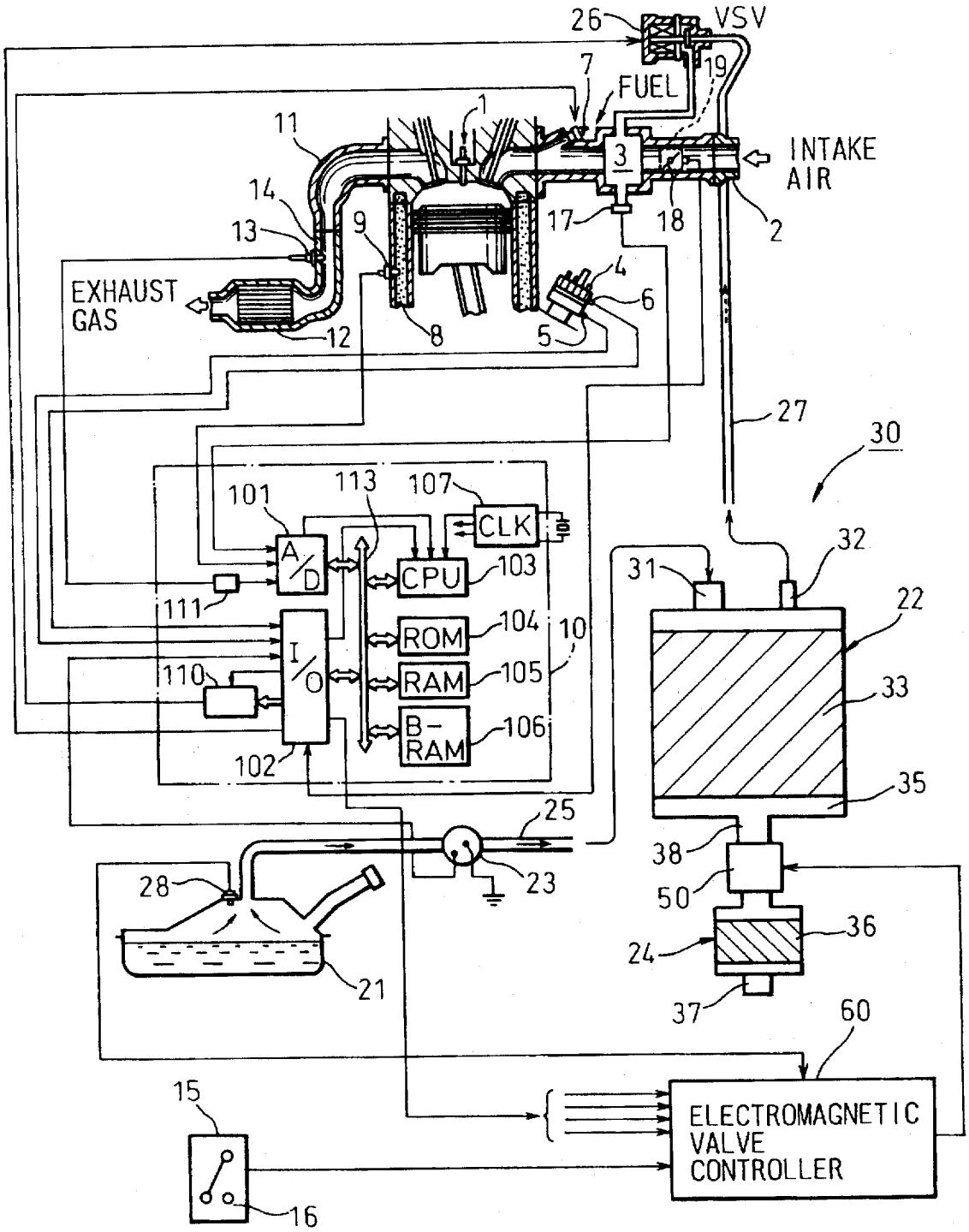
FIG. 6A is a drawing which shows the overall configuration of third embodiment of fuel-vapor emission-control system for an internal combustion engine according to the present invention, along with an internal combustion engine.

FIG. 6A is shows the configuration of the third embodiment of the present invention, this being a simplified representation of an electronically controlled internal combustion engine 1 which is provided with a fuel-vapor emission-control system 30 of the second aspect of the present invention. Elements in FIG. 6A that are the same as elements previously described in connection with FIG. 1 have been assigned the same reference numerals as in FIG. 1, and are not explicitly described herein, only the differing parts being described.

In the third embodiment, as is the case with the second embodiment, a buffer canister 24 is provided on the atmospheric side of the canister 22. In the second embodiment, the buffer canister 24 is connected via a constricted atmospheric port 34 and the second atmospheric port 45 of the flow control valve 40. In the third embodiment, however, the buffer canister 24 is connected to the canister 22 via a connecting pipe 38, which has a large cross-sectional area. At an intermediate location along this connecting pipe 38 is provided an electromagnetic valve 50 which is a flow control valve capable of adjusting the flow of air through the connecting pipe 38, by means of the degree of opening of the valve.

Figure 6B:
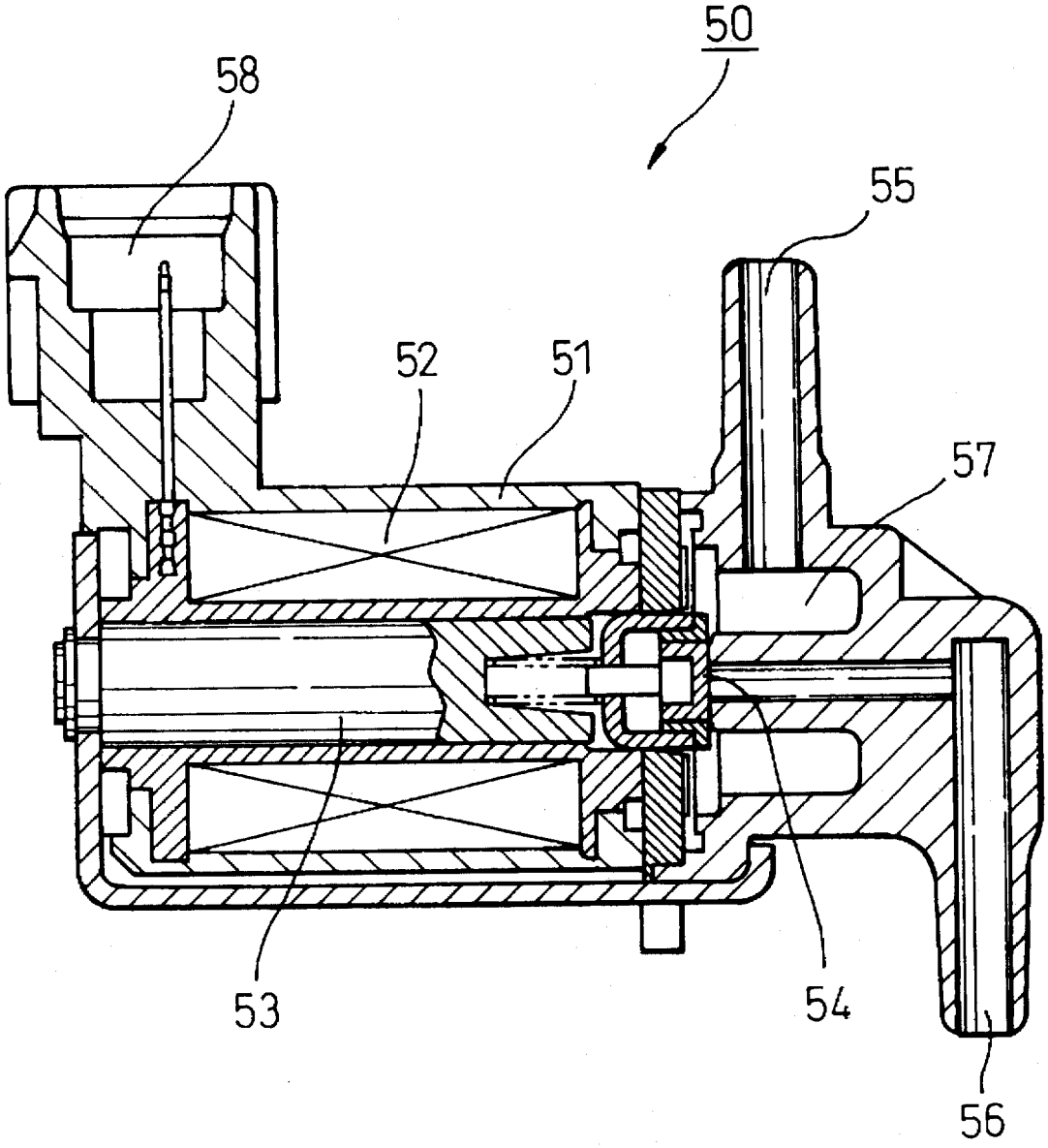
FIG. 6B is a cross-sectional view which shows an example of the configuration of the electromagnetic valve shown in FIG. 6A.

It is possible to use a known duty-cycle controlled VSV, a linear solenoid valve, or a rotary valve or the like as this electromagnetic valve 50. FIG. 6B shows an example of the configuration in the case in which the electromagnetic valve 50 is a duty-cycle controlled VSV. Inside housing 51 of the electromagnetic valve 50 is provided a coil 52, inside which is provided a plunger 53, which is driven by this coil 52. The coil 52 is electrically connected to a connector 58 which is provided on one end of the housing 51, the plunger 53 moving in response to the duty cycle of the control signal input to this connector 58. On the end part of this plunger 53 is mounted a valve 54, the opening of the internal path 57 of which is changed by means of the movement of the plunger 53. The internal path 57 is connected by means of port 55 to the canister 22 which is shown in FIG. 1A, and is further connected by means of port 56 to the buffer canister 24 which is shown in FIG. 6A.

The degree of opening of this electromagnetic valve 50 is controlled by a control signal from an electromagnetic valve controller 60. The electromagnetic valve controller 60 has within it (not shown in the drawing) a microcomputer having a configuration similar to the above-described control circuit 10. The electromagnetic valve controller 60 has input to it a pressure detection signal from the internal pressure sensor 28 provided in the fuel tank 21, a refueling signal from a refueling detection switch 16 provided on a lid opener 15, and signals such as intake air temperature signal, running time signal, and ignition switch signal from the control circuit 10. For this reason, signals from an igniter (not shown in the drawing) and an intake air temperature sensor are input to the control circuit 10.

Figure 7:
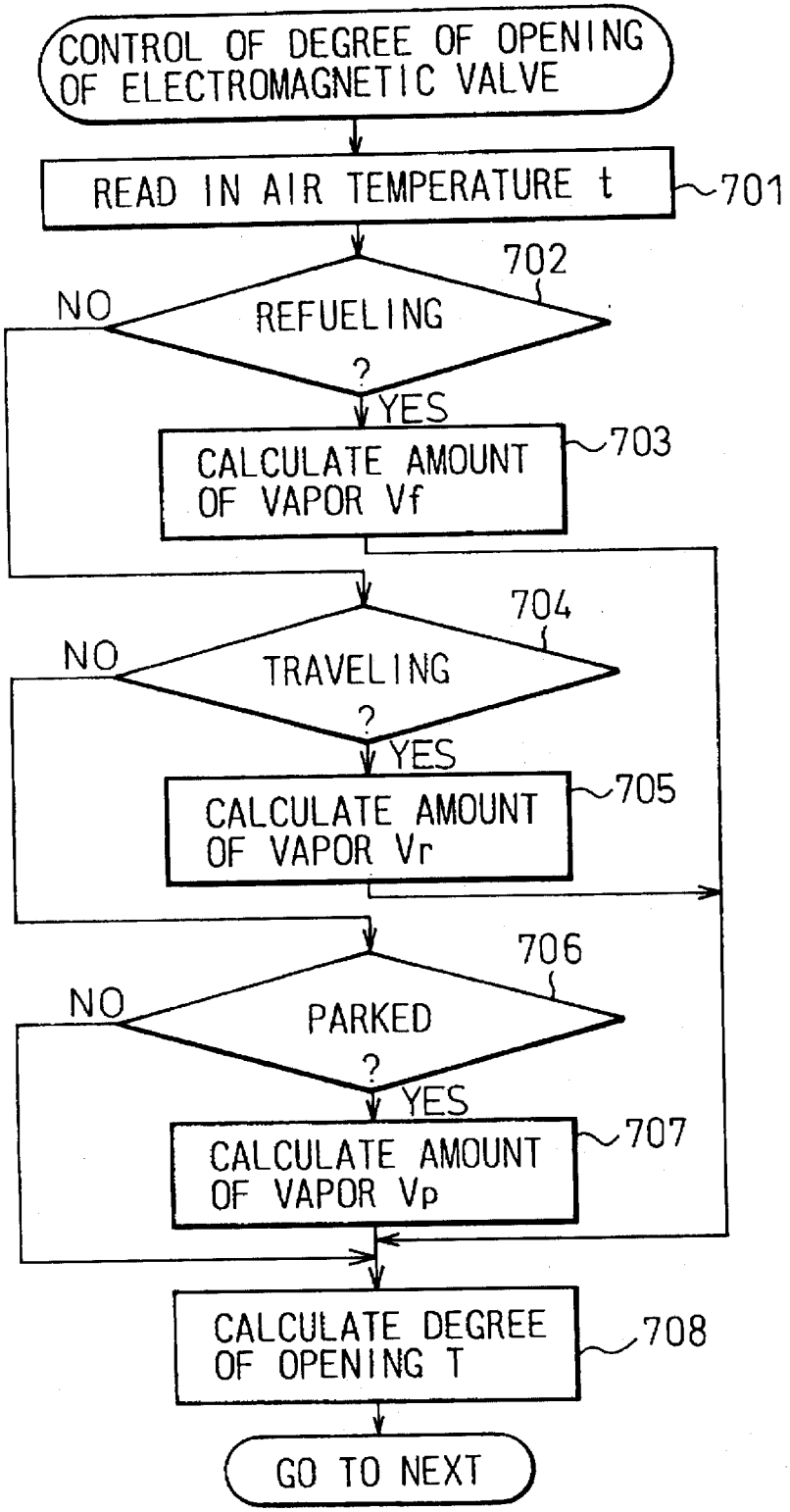
FIG. 7 is a flowchart which shows an example of the degree of opening control procedure for the electromagnetic valve in the fuel-vapor emission-control system for an internal combustion engine shown in FIG. 6.

FIG. 7 is a flowchart which shows an example of the degree of opening control procedure for the electromagnetic valve 50 of the electromagnetic valve controller.

At step 701, the air temperature input from the control circuit 10 is read in. Then, at step 702, a judgment is made of whether or not refueling is being done is made by means of a refueling signal from the refueling detection switch 16. If refueling is not being done, control proceeds to step 704, but if refueling is in progress a calculation is made, at step 703, of the amount of vapor Vf during refueling. The calculation of the amount of vapor Vf during refueling is performed using the air temperature versus amount of vapor characteristics marked f (characteristics during refueling) of FIG. 9B, which has the operating condition as a parameter. The air temperature versus vapor amount characteristics, with operating condition as a parameter, are stored in the form of a map in the electromagnetic valve controller 60. When the intake air temperature signal from the control circuit 10 is input to the electromagnetic valve controller 60, the amount of vapor Vf responsive to the air temperature is determined by means of interpolation of the map of the f characteristics by the electromagnetic valve controller 60.

Figure 9A:
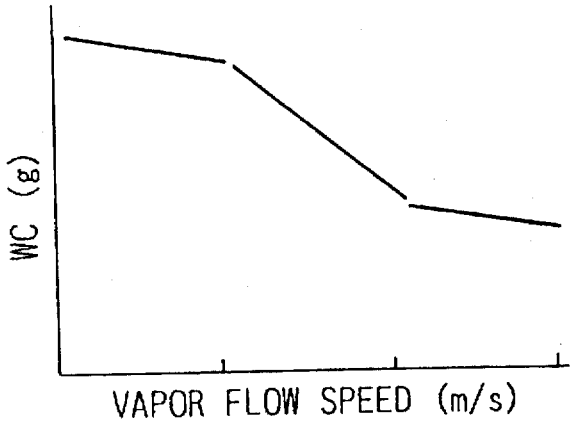
FIG. 9A is a graph which shows the relationship between the vapor flow speed in the canister and the working capacity of the canister.
Figure 9B:
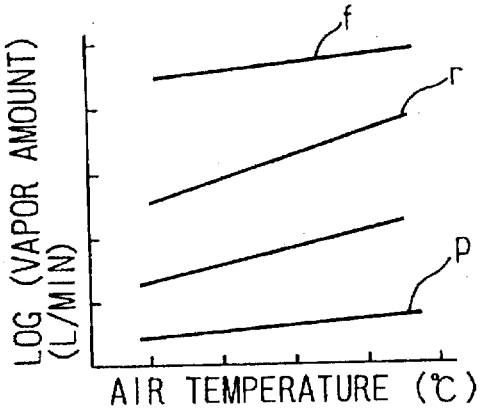
FIG. 9B is a graph which shows the relationship between the air temperature and the amount of vapor flow.
Figure 9C:
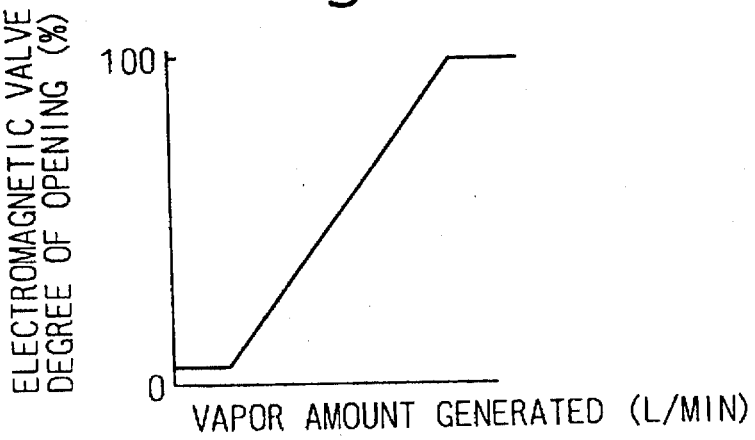
FIG. 9C is a graph which shows the relationship between the amount of vapor generated and the opening degree of the electromagnetic valve.

At step 703, after the amount of vapor Vf when refueling is determined by means of interpolation, control proceeds to step 708. At step 708, the degree of electromagnetic valve opening T during refueling is determined using the amount of vapor versus electromagnetic valve degree of opening characteristics shown in FIG. 9C. The amount of vapor versus electromagnetic valve degree of opening characteristics curve shown in FIG. 9C are stored in the form of a map in the electromagnetic valve controller 60. Therefore, at step 708, the electromagnetic valve controller 60 calculates the degree of opening T of the electromagnetic valve during refueling by interpolation of the map of the characteristics of FIG. 9C. When the degree of opening T of the electromagnetic valve for refueling is determined in this manner, this routine is ended.

If at step 702 the judgment is made that refueling is not being done, control proceeds to step 704, at which point a determination is made as to whether or not the vehicle is moving. In the case in which the vehicle is not traveling, control proceeds to step 706. If, however, the vehicle is traveling, control proceeds to step 705. At step 705, a calculation is performed of the amount of vapor Vr when the vehicle is traveling. The calculation of the amount of vapor Vr when the vehicle is traveling is made in the same manner as described in detail with regard to step 703, by performing interpolation of the map of the air temperature versus amount of vapor characteristics marked with the symbol r (traveling characteristics) which use the vehicle operating condition as a parameter, as shown in FIG. 9B. After the amount of vapor Vr when the vehicle is traveling is calculated by interpolation at step 705, control proceeds to step 708. At step 708, following the procedure described earlier, the degree of opening T of the electromagnetic valve for the vehicle traveling is determined by interpolation of the map of the amount of vapor generated versus electromagnetic valve degree of opening characteristics shown in FIG. 9C. After the degree of opening T of the electromagnetic valve is determined in this manner, this routine is ended.

In addition, if at step 704 the vehicle is judged to be not traveling, control proceeds to step 706, at which a determination is made as to whether or not the vehicle is parked. If the vehicle is not parked, control proceeds to step 708, at which a calculation is made of the degree of opening T of the electromagnetic valve 50 in response to the air temperature t. Control would shift to step 708 in such cases as when the vehicle is stopped with the engine idling.

If, however, at step 706 the judgment is made that the vehicle is parked, control proceeds to step 707, at which a calculation is made of the amount of vapor Vp when parked. The calculation of the amount of vapor Vp when the vehicle is parked is performed by interpolation of the map of the air temperature versus amount of vapor characteristics p (characteristics during the parked condition) which use the operating conditions as a parameter, as shown in FIG. 9C, and as described in detail with regard to step 703. After the amount of vapor Vp during the parked condition is determined in this manner at step 707, control proceeds to step 708. At step 708, the previously described procedure is followed to determine the degree of opening T of the electromagnetic valve when in the parked condition, by interpolation of a map of the amount of vapor generated versus degree of electromagnetic valve opening characteristics that are shown in FIG. 9C. When the degree of opening T of the electromagnetic valve during the parked condition is determined in this manner, this routine is ended.

The degree of opening T of the electromagnetic valve 50 during the vehicle conditions of refueling, traveling, and parking can be measured beforehand as the degree of opening of the electromagnetic valve 50 so that the internal pressure in the fuel tank 21 is within a prescribed range, this being stored as a database in a memory within the electromagnetic valve controller 60. It is also possible to determine the amount of vapor with parameters such as fuel temperature and vapor temperature.

By performing control of the degree of opening T of the electromagnetic valve 50 in response to the amount of vapor, as described above, it is possible to perform precise control of the amount of vapor flow, enabling the control of the flow so that the internal pressure in the fuel tank 21 is maximized within the limits imposed by tank strength and fuel supply performance requirements. For this reason, the velocity of the vapor flow in the canister 22 is slowed, thereby improving its working capacity (WC). FIG. 9A shows the relationship between the vapor flow velocity and the working capacity of the canister 22. It can be seen from this drawing that the working capacity increases as the vapor velocity decreases.

Figure 8:
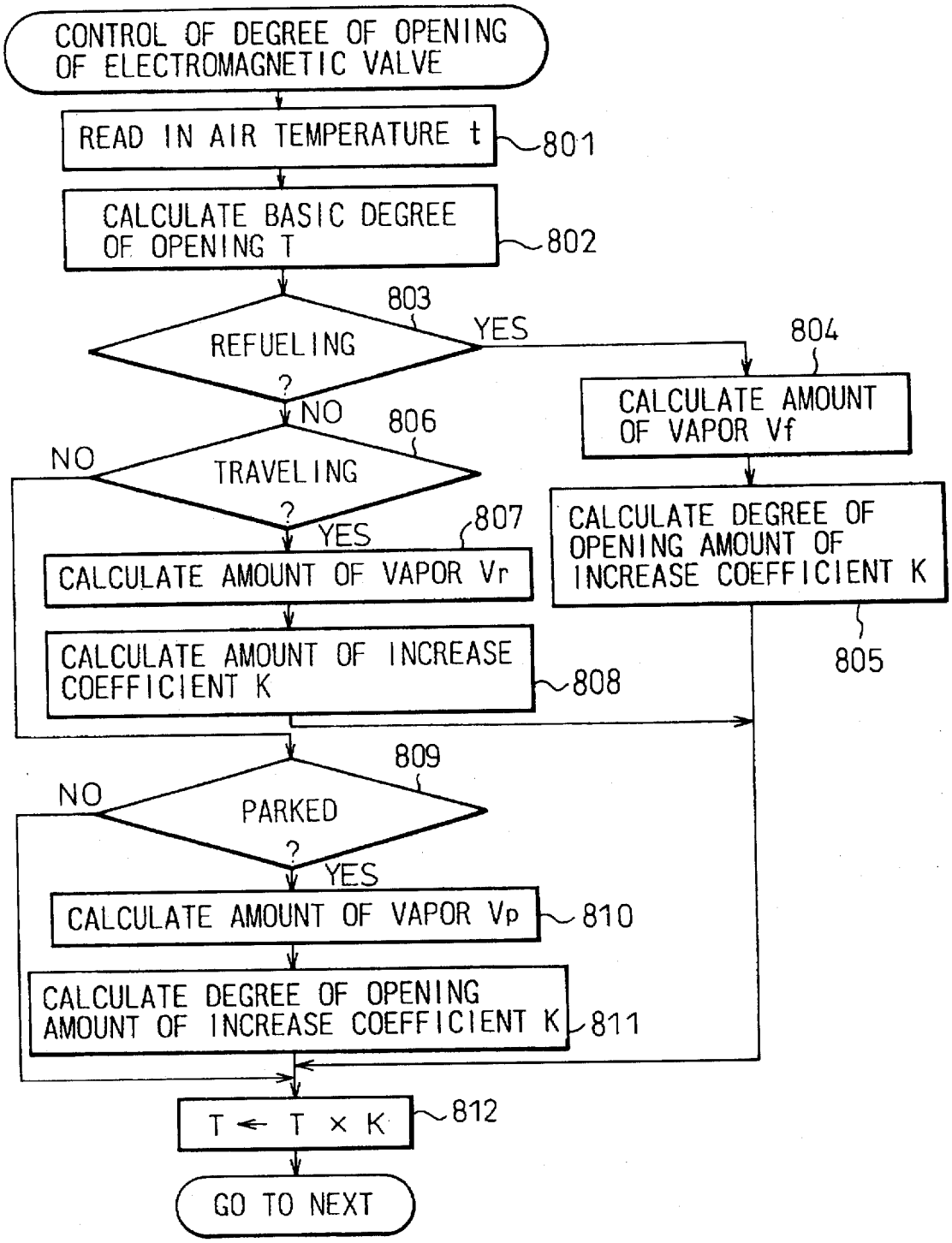
FIG. 8 is a flowchart which shows a example of a variation of the flowchart which is shown in FIG. 7.

FIG. 8 is a flowchart which shows another example of an electromagnetic valve degree of opening control procedure for the electromagnetic valve controller 60.

At step 801, the air temperature which is input from the control circuit 10 is read in, after which, at step 802, the basic degree of opening T of the electromagnetic valve 50 at the amount of vapor based on this temperature t is calculated. The basic degree of opening T of the electromagnetic valve 50 can be determined by performing interpolation of the map of the amount of vapor generated versus electromagnetic valve degree of opening characteristics which are shown in FIG. 9C.

Then, at step 803, a judgment is made as to whether or not refueling is being done. If the judgment is that refueling is not in progress, control proceeds to step 806, but if the judgment is that refueling is in progress, at step 804 a calculation is made of the amount of vapor Vf during refueling. The calculation of the amount of vapor Vf during refueling is made by performing interpolation of the map of the air temperature versus amount of vapor generated characteristics marked f (refueling characteristics) shown in FIG. 9B. At step 805, the amount of increase coefficient K of the degree of opening T of the electromagnetic valve 50 responsive to the amount of vapor Vf calculated for refueling is calculated, after which control proceeds to step 812.

However, at step 803 if the judgment is that refueling is not being done, control proceeds to step 806, at which a judgment is made as to whether or not the vehicle is traveling. In the case in which the vehicle is not traveling, control proceeds to step 809, but if the vehicle is traveling, control proceeds to step 807, at which a calculation is performed of the amount of vapor Vr during traveling. The calculation of the amount of vapor Vr during traveling is made by interpolating a map of the air temperature versus amount of vapor characteristic curve with the symbol r (characteristics when traveling) in FIG. 9B, which uses the vehicle operating condition as a parameter. After the amount of vapor during traveling is determined at step 807, control proceeds to step 808, at which an amount of increase coefficient K of the degree of opening T of the electromagnetic valve 50, responsive to the calculated amount of vapor Vr for traveling, is calculated, after which control proceeds to step 812.

In addition, if the judgment at step 806 is that the vehicle is not traveling, control proceeds to step 809, at which a judgment is made as to whether or not the vehicle is parked. In the case in which the vehicle is not parked, control proceeds to step 812, but if the vehicle is parked, control proceeds to step 810, at which a calculation is performed of the amount of vapor Vp during parking. The calculation of the amount of vapor Vp during parking can be made by performing interpolation of the air temperature versus amount of vapor characteristics marked p (characteristics when parked) in FIG. 9B, which uses the vehicle operating condition as a parameter. After the amount of vapor Vp during the parked condition are determined by interpolation at step 810, control proceeds to step 811, a calculation is made of the amount of increase coefficient K of the degree of opening T of the electromagnetic valve 50 is made, and control proceeds to step 812.

After calculating the amount of increase coefficient K of the degree of opening T of the electromagnetic valve 50 as described above, the basic degree of opening T of the electromagnetic valve 50, which is calculated at step 802, is corrected at step 812 to be $T=T\times K$. This amount of increase coefficient K is a value of 1 or greater, and is 1 when not calculated at steps 805, 808, and 811.

In this embodiment, the amount of increase coefficient K of the basic degree of opening T of the electromagnetic valve can be stored as a database in memory within the electromagnetic valve controller 60, by measuring beforehand the amount of vapor and degree of opening of the electromagnetic valve at which the internal pressure inside the fuel tank 21 is within a prescribed limit. This method as well can be used to control the degree of opening T of the electromagnetic valve 50, responsive to the amount of vapor, and to perform precise flow control of the vapor. As a result, it is possible to limit the amount of flow so it is maximum, within a range in which the internal pressure within the fuel tank 21 satisfies the tank's strength and refueling performance, and to improve the working capacity of the canister 22.

Figure 10:
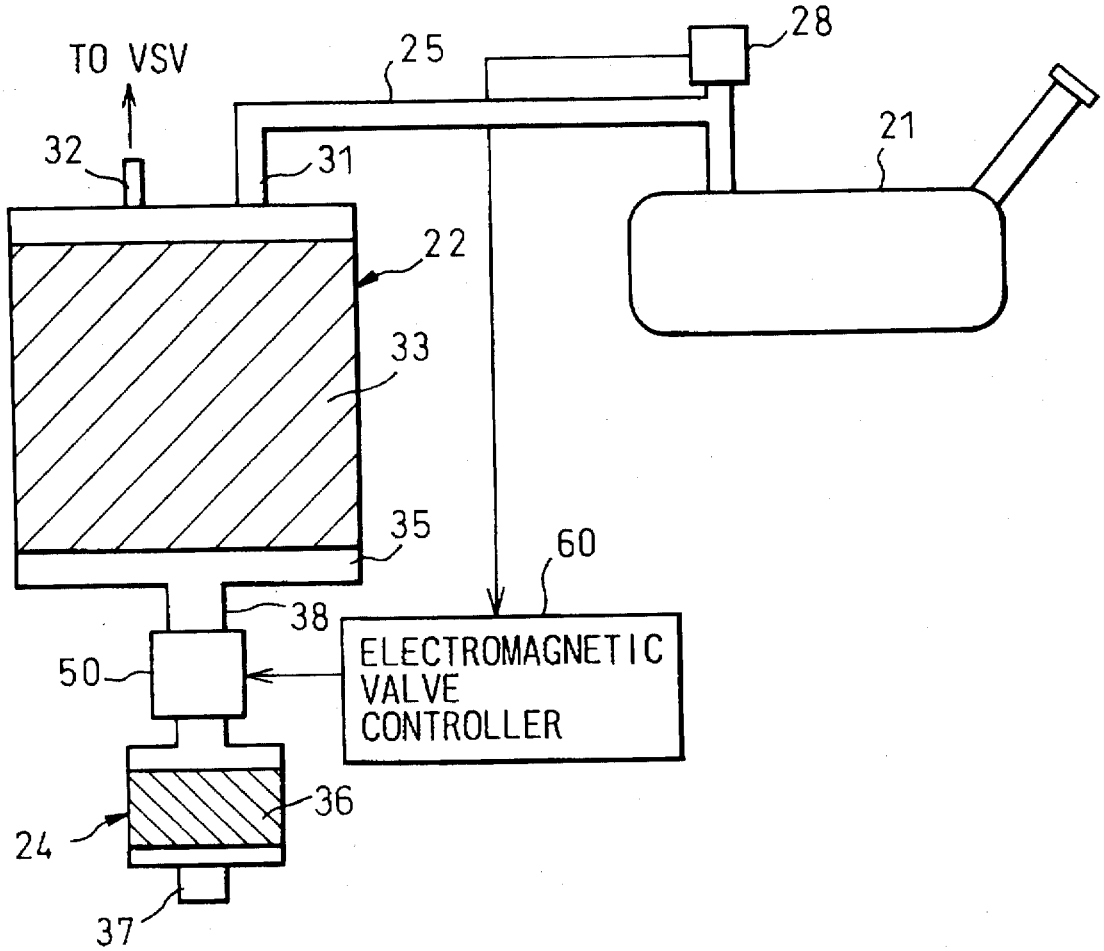
FIG. 10 is a drawing which shows the configuration of the fourth embodiment of fuel-vapor emission-control system for an internal combustion engine according to the present invention.

FIG. 10 shows the configuration of the fourth embodiment of the present invention, which shows the configuration of the main part of a fuel-vapor emission-control system 30 configuration of the second aspect of the present invention. In this embodiment, the internal combustion engine 1 is not illustrated, constitutional elements the same as previously noted elements being assigned the same reference numerals. It is possible to use an electromagnetic valve 50 having the same configuration as in FIG. 6B.

Figure 11:
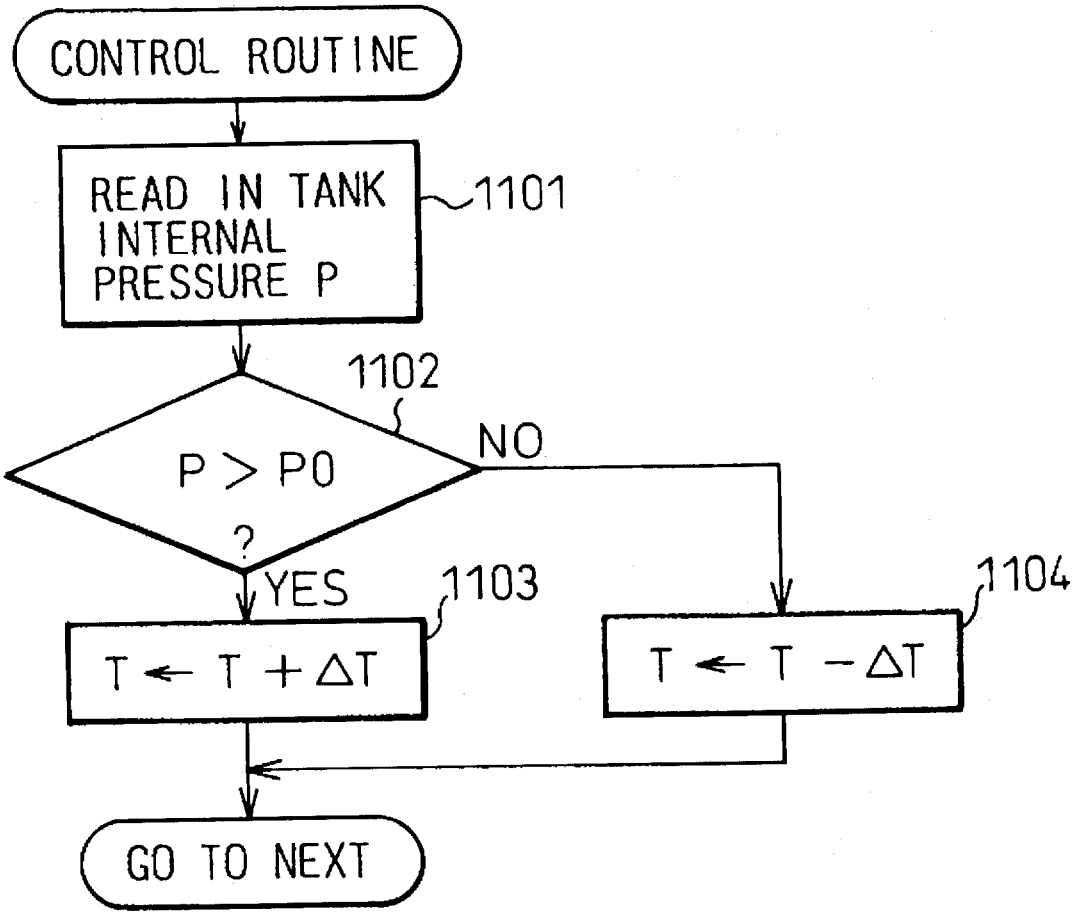
FIG. 11 is a flowchart which shows a degree of opening control procedure for the electromagnetic valve in the fuel-vapor emission-control system for an internal combustion engine shown in FIG. 10.

In the fourth embodiment of the present invention, the electromagnetic valve controller 60 performs feedback control of the degree of opening of the electromagnetic valve 50 in response to an internal tank pressure detection signal from an internal pressure sensor 28 provided in the fuel tank 21. That is, the electromagnetic valve controller 60 performs control so as to keep the internal pressure in the fuel tank 21 constant, by making the degree of opening of the electromagnetic valve 50 larger when the internal pressure in the tank, detected by the internal pressure sensor 28, is larger. The control procedure is described below, with reference made to the flowchart in FIG. 11.

First, at step 1101, the tank internal pressure P, which is detected by the internal pressure sensor 28, is read in. Then, at step 1102, a judgment is made as to whether or not the read in internal pressure P is greater than a reference internal pressure Po. In the case of $P>Po$, control proceeds to step 1103, at which the degree of opening T of the flow control valve 50 is increased by a prescribed amount $\Delta T$. If at step 1102, $P\leqq Po$, control proceeds to step 1104, at which the degree of opening T of the flow control valve 50 is decreased by the prescribed amount $\Delta T$. In this manner, by applying feedback control of the tank internal pressure P, the internal pressure within the fuel tank 21 is maintained constantly at the reference value.

Figure 12:
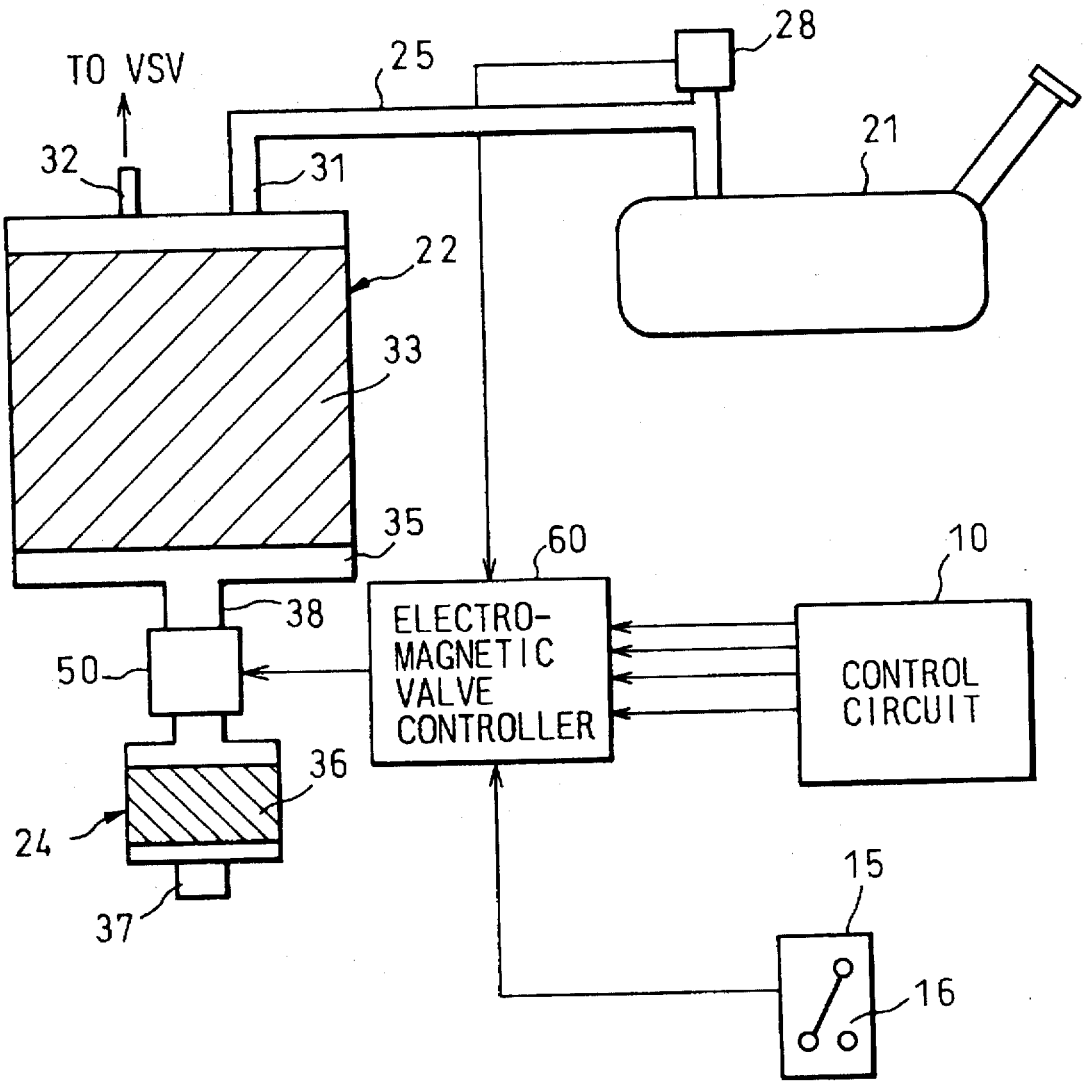
FIG. 12 is a drawing which shows the configuration of the fifth embodiment of fuel-vapor emission-control system for an internal combustion engine according to the present invention.

FIG. 12 shows the configuration of the fifth embodiment of the present invention, which shows the configuration of the main part of a fuel-vapor emission-control system 30 of the second aspect of the present invention. In this embodiment, the internal combustion engine 1 is not shown, and constitutional elements the same as those previously noted elements have been assigned the same reference numerals.

In the fifth embodiment, the flow control valve controller 60 has connected to it such signals as a pressure detection signal from the internal pressure sensor 28 provided in the fuel tank 21, a refueling signal from a refueling detection switch 16 which is provided on a lid opener 15 for the purpose of opening the lid (not shown in the drawing) of the fuel tank 21 which is located on the driver's seat side, an air temperature signal from the control circuit 10, an operating time signal, and operating condition parameter signals such as an igniter switch signal.

In the fifth embodiment, the feedback control lag when refueling is reduced in comparison with the fourth embodiment. Specifically, because the amount of vapor is greater when refueling than when parked or traveling, if a feedback control of the degree of opening of the flow control valve 50 is performed in response to an internal pressure detection signal from an internal pressure sensor 28 which is provided in the fuel tank 21, such as in the fourth embodiment, there are cases in which control delay can cause overshoot of the internal pressure in the fuel tank 21, so that the prescribed pressure is greatly exceeded.

Figure 13:
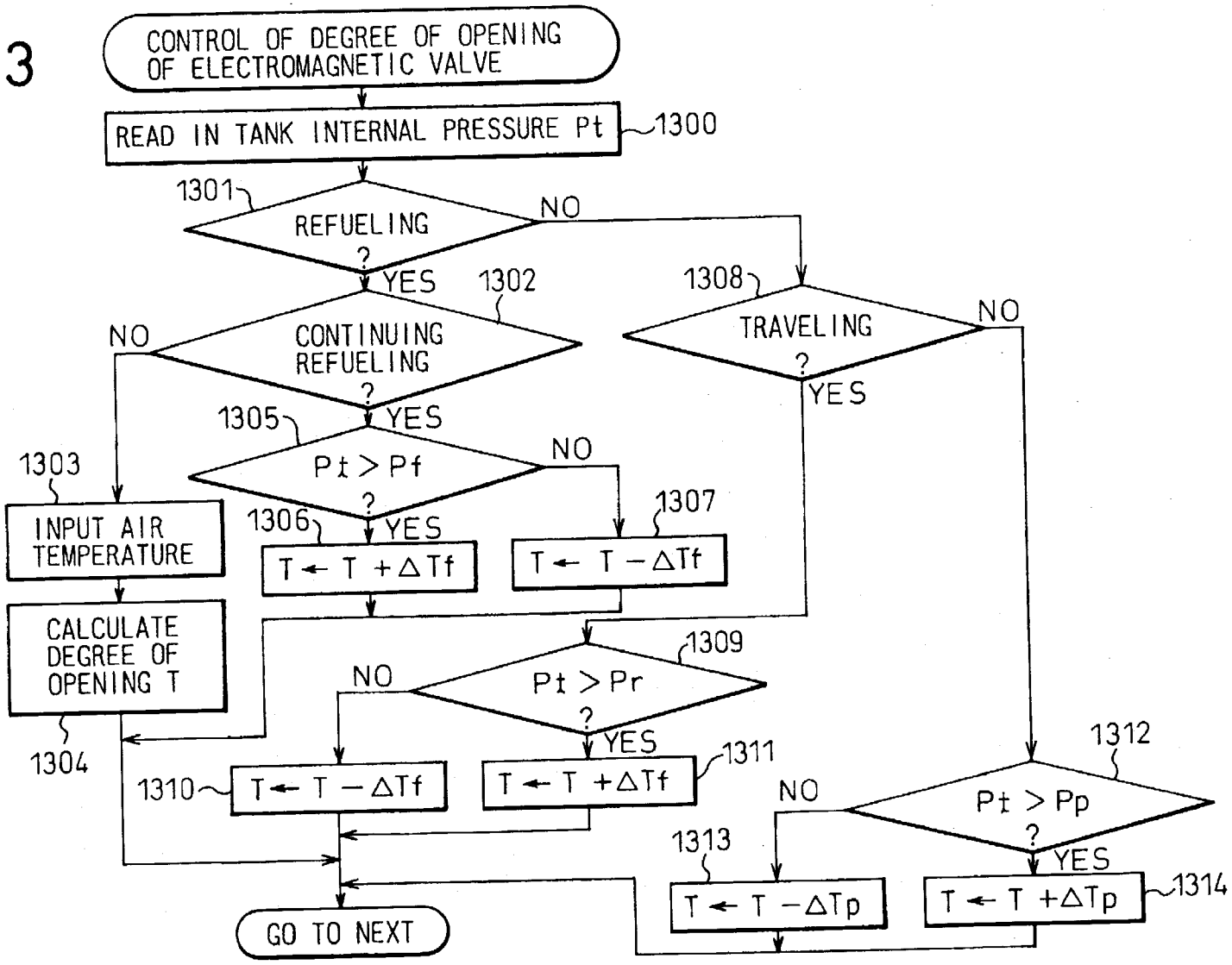
FIG. 13 is a flowchart which shows the operating procedure of the electromagnetic valve shown in FIG. 12.

The fifth embodiment is for the purpose of preventing the above-noted control delay, and will be described below, with reference being made to the control procedure shown in the flowchart of FIG. 13. In this embodiment, in addition to the internal pressure sensor 28, the flow control valve 50 is controlled by a refueling signal and an air temperature signal or the like.

First, at step 1300, the internal tank pressure Pt detected by the internal pressure sensor 28 is read in. Then, at step 1301 a judgment is made as to whether or not refueling is being done. In the case in which the judgment at step 1301 is that refueling is being done, control proceeds to step 1302, at which a judgment is made as to whether or not refueling is being continued. If the judgment is that refueling is not being done, control proceeds to step 1308, at which a judgment is made as to whether or not the vehicle is traveling.

Figure 14:
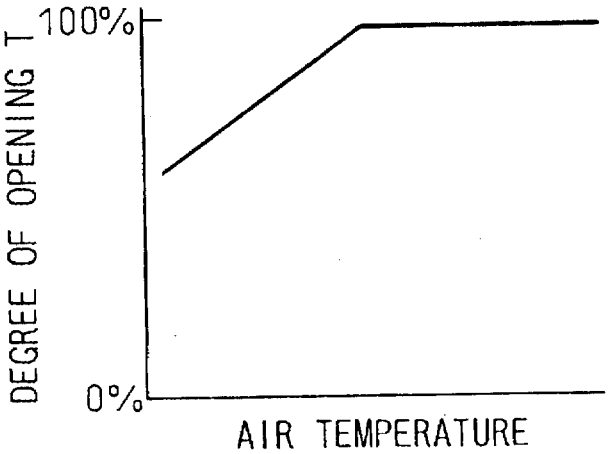
FIG. 14 is a graph which shows the relationship between the air temperature and the degree of opening of the electromagnetic valve, when the initial value of the degree of opening is established in response to the air temperature, for the case of refueling as shown in the flowchart of FIG. 12.

First, take the case in which refueling is being done. If the judgment at step 1301 is that refueling is being done, a judgment is made at step 1302 as to whether or not refueling is being continued. In the case in which the judgment at step 1302 is that refueling is not being continued, this indicates the condition immediately after the start of refueling. In this case, control proceeds to step 1303, at which the air temperature is read in, after which a calculation is performed of the initial degree of opening T during refueling of the flow control valve 50, responsive to the air temperature. This initial degree of opening T can be determined by interpolation of a map of the air temperature versus degree of opening characteristics shown in FIG. 14 and stored in a memory in the flow control valve controller 60.

After calculating the initial degree of opening T during refueling of the flow control valve 50 in this manner, when step 1302 is encountered in subsequent executions of this routine, the judgment is made that refueling is being continued, and control proceeds to step 1305. At step 1305 judgment is made of the relative magnitudes of the tank internal pressure Pt detected at step 1300 and the target internal pressure value Pf for refueling. Feedback control is applied so that, if Pt>Pf, at step 1306 the degree of opening T of the flow control valve 50 is increased by a prescribed amount ΔT. If Pt≦Pf at step 1307 the degree of opening T is decreased by the prescribed amount ΔT.

Next, the case in which the vehicle is traveling will be described. If the vehicle is traveling, the judgment at step 1301 will be that refueling is not being done, and if the judgment is made that the vehicle is traveling, control proceeds to step 1309. At step 1309, the relative magnitudes of the tank internal pressure Pt detected at step 1300 and the target internal pressure value Pr during traveling are compared, and feedback control is applied so that, if Pt>Pt, the degree of opening T of the flow control valve 50 is increased at step 1310 by a prescribed amount ΔT. If, however, Pt≦Pr, the degree of opening T is decreased by the prescribed amount ΔT at step 1311.

Finally, the case in which the vehicle is parked will be described. In this case, the judgment at step 1301 is that refueling is not being done, and the judgment at step 1308 is that the vehicle is not traveling, at which point control proceeds to step 1312. At step 1312, a comparison is made of the relative magnitudes of the tank internal pressure Pt which was detected at step 1300 and the target internal pressure value Pp for the parked condition, feedback control being applied so that, if Pt>Pp, the degree of opening T of the flow control valve 50 is increased by a prescribed amount ΔT at step 1313. If Pt≦Pp, at step 1314, the degree of opening T of the flow control valve 50 is decreased by the prescribed amount ΔT.

In this manner, in the fifth embodiment of the present invention, it is possible to perform feedback control of the internal pressure inside the fuel tank 21 to the respective target values for the conditions of parking and traveling, and it is possible to control to the target value for the refueling condition without control delay.

Figure 15:
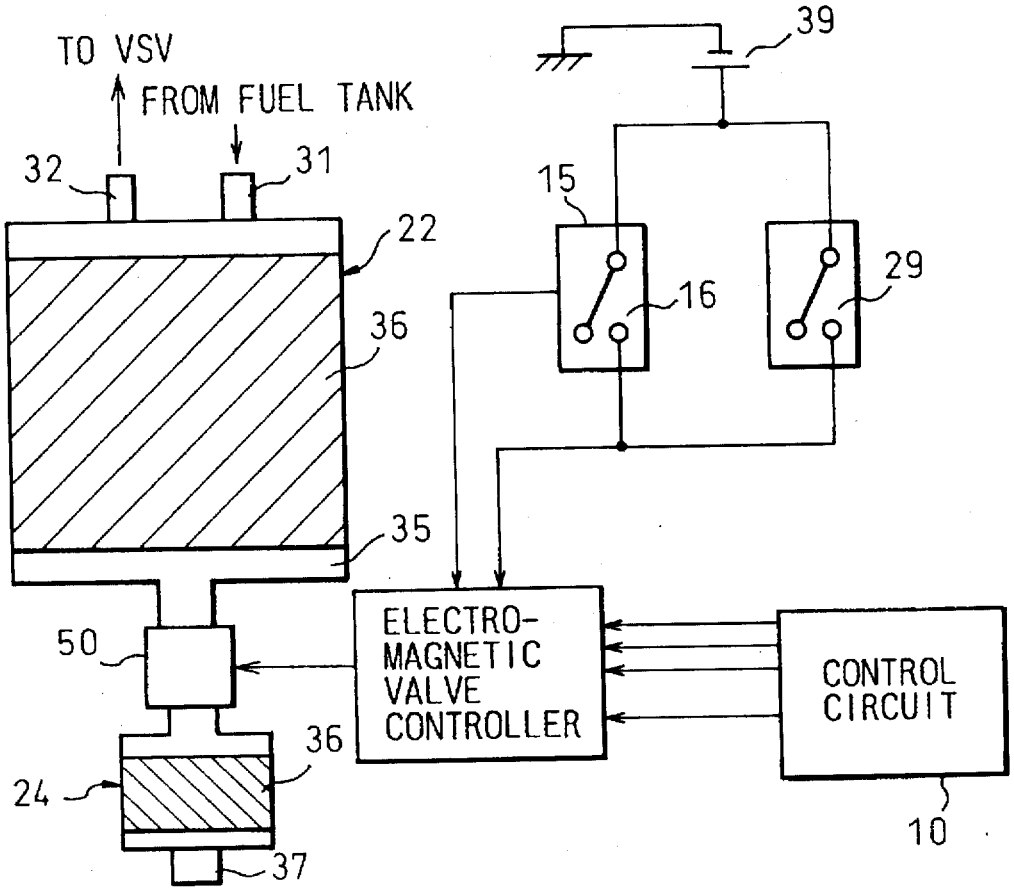
FIG. 15 is a drawing which shows the configuration of the sixth embodiment of a fuel-vapor emission-control system for an internal combustion engine according to the present invention.

FIG. 15 shows the configuration of the sixth embodiment of the present invention, this showing the configuration of the main part of a fuel-vapor emission-control system 30 configuration of the second aspect of the present invention. In this embodiment, the internal combustion engine 1 is not illustrated, the constitutional elements the same as those previously noted elements being assigned the same reference numerals.

In this embodiment, as described with reference to FIG. 3, since the amount of vapor during the parked condition is extremely small, control is performed so that the degree of opening T of the flow control valve 50 during parking is taken to be fixed, this being the difference in this embodiment with respect to the above-described embodiments. In this embodiment, therefore, control of the degree of opening of the flow control valve 50 responsive to the amount of vapor is done only during refueling and when the vehicle is traveling. Because the method of controlling the degree of opening of the flow control valve 50 during refueling and traveling was described for above-noted embodiments, this description will be omitted from this embodiment, the description being presented below with respect to the parked condition only.

In addition to such signals as pressure detection signal from the internal pressure sensor 28 provided in the fuel tank 21, a refueling signal from a refueling detection switch 16 which is provided on a lid opener 15 for the purpose of opening the lid (not shown in the drawing) of the fuel tank 21 which is located on the driver's seat side, an air temperature signal from the control circuit 10, an operating time signal, and operating condition parameter signals such as an igniter switch signal, the electromagnetic valve controller 60 of the sixth embodiment of the present invention has input to it an on/off signal of an ignition switch 29 of the vehicle. The refueling detection switch 16 and ignition switch 29 are both connected to the vehicle-mounted battery 39.

In the sixth embodiment, the electromagnetic valve controller 60 is connected to the battery 39 whenever the lid opener 15 is open or the ignition switch 29 is on. Therefore, in the sixth embodiment, the electromagnetic valve controller 60 controls the degree of opening of the electromagnetic valve 50 when connected to the battery 39, and operates to hold the tank internal pressure within a prescribed value range.

Figure 16A:
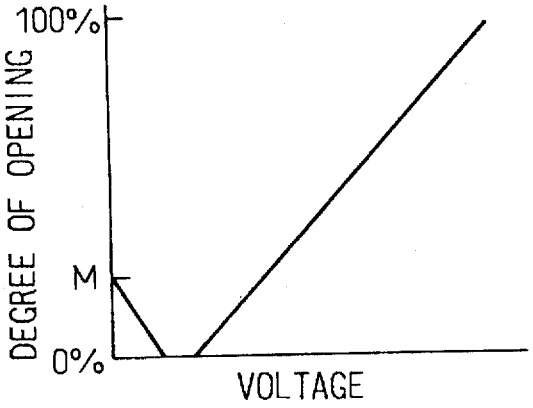
FIG. 16A is a graph which shows one example of the relationship between the degree of opening and the voltage of the electromagnetic valve in the sixth embodiment.

In this embodiment, because the refueling detection switch 16 is in the off condition when the vehicle is in the parked condition as not being refueled, there is no connection of the electromagnetic valve controller 60 at the battery 39, so that the electromagnetic valve controller 60 power supply is in the off condition. In this embodiment, the degree of opening of the electromagnetic valve 50 when the electromagnetic valve controller 60 power supply is in the off condition is set to be a prescribed degree of opening M, such as shown in FIG. 16A.

Therefore, in the sixth embodiment, when the ignition switch 29 is off, although the electrical energy to the electromagnetic valve controller 60 is cut off, because the degree of opening is held at some prescribed value of opening M, the tank internal pressure is held to a prescribed limit. Also, in this condition, because the electromagnetic valve controller 60 is in the off condition, it is possible to reduce the power supply load on the battery 39. In addition, in the sixth embodiment, for the purpose of checking the canister, immediately after the ignition switch 29 is set to off, the degree of opening of the electromagnetic valve 50 is temporarily set to zero.

Figure 16B:
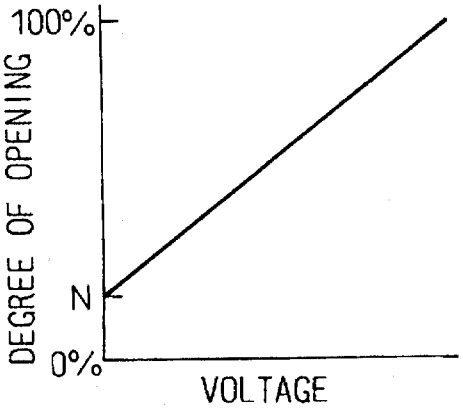
FIG. 16B is a graph which shows another example of the relationship between the degree of opening and the voltage of the electromagnetic valve in the sixth embodiment.

Furthermore, it is possible, as shown in FIG. 16B, to set the degree of opening characteristics of the electromagnetic valve 50 such that degree of opening of the electromagnetic valve 50 just after setting the power supply of the electromagnetic valve controller 60 to off is a prescribed value of opening N, with the degree of opening increasing linearly with an increase in the voltage. In general, because the amount of vapor generation is smallest when a vehicle is parked, the characteristics can be set so that the degree of opening of the electromagnetic valve 50 is minimum during the parked condition.

Figure 17A:
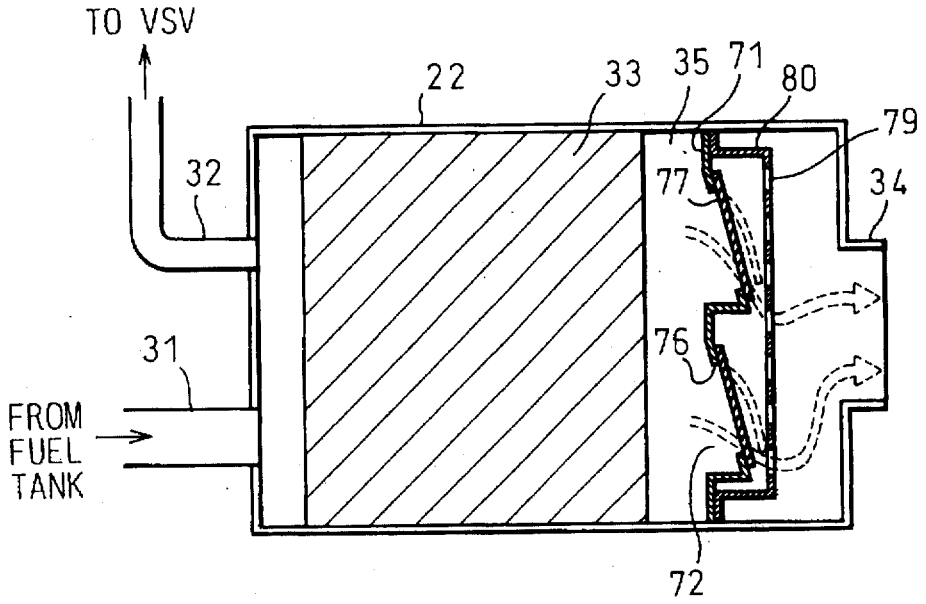
FIG. 17A is a drawing which shows the configuration of the seventh embodiment of a fuel-vapor emission-control system for an internal combustion engine according to the present invention.
Figure 17B:
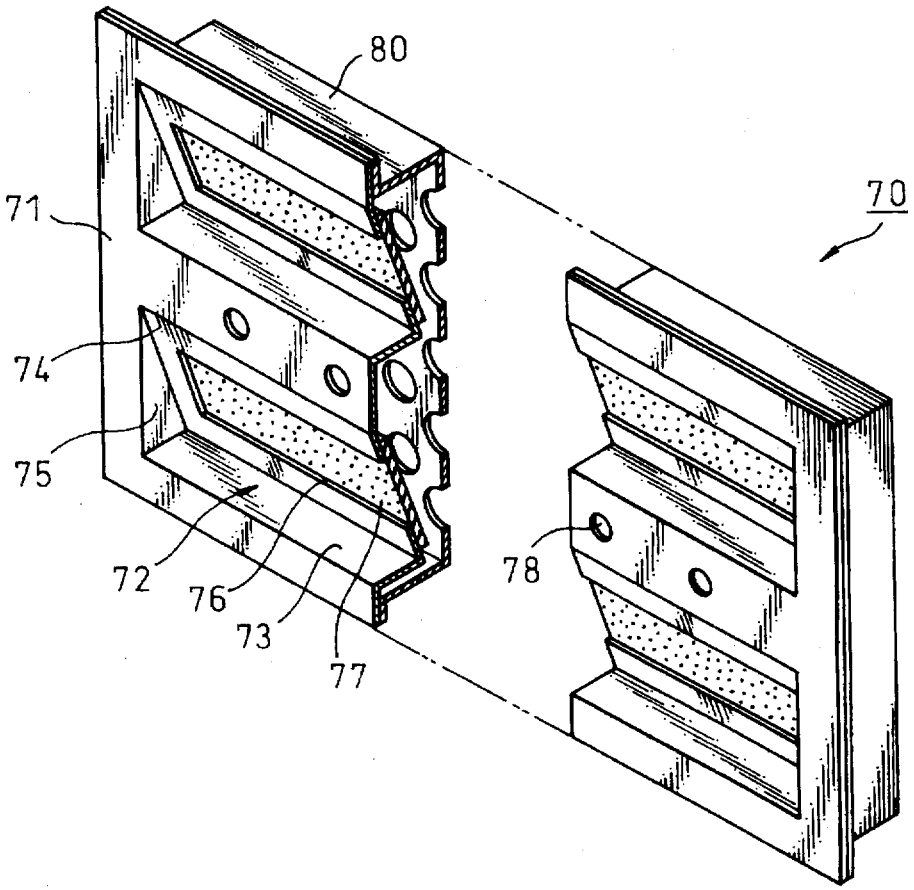
FIG. 17B is a perspective view which shows the details of the configuration of the flow control valve which is included within the canister which is shown in FIG. 17A, with the flow control valve split into two parts.

FIG. 17A and FIG. 17B show an example of the configuration of a seventh embodiment of the present invention, these showing the configuration of the canister 22 of a first aspect of a fuel-vapor emission-control system for an internal combustion engine according to the present invention. In this embodiment as well, constitutional elements which have already appeared in connection with other embodiments are assigned the same reference numerals.

The canister 22 of the seventh embodiment, as shown in FIG. 17A, is generally provided with a tank port 31 which connects to a vapor delivery pipe 25, a purge port 32 which connects to a vapor return pipe 27, activated charcoal 33 which adsorbs vapor, and an atmospheric port 34. An atmospheric chamber 35 is provided between the atmospheric port 34 and the activated charcoal 33. In the seventh embodiment, a vapor path dividing valve 70 is provided within the atmospheric chamber 35 to function as a flow control valve. In the canister 22 of the seventh embodiment, the vapor path dividing value 70 is provided perpendicular with respect to the horizontal direction.

FIG. 15B shows the construction of the vapor path dividing valve 70 separately, with this valve split by a vertical plane into two parts. As shown in FIG. 17B, the vapor path dividing valve 70 has a dividing plate 71 which divides the atmospheric chamber 35 perpendicularly with respect to the horizontal plane. This dividing plate 71 is provided with depressions 72, which extend in the horizontal direction, at two locations. In the horizontal direction of each of these depressions 72 is formed a vertical side wall 73, an inclined surface 74 connecting between the edge of each of the side walls 73 and each of the depressions. Each of the ends in the longitudinal direction of the depressions 72 is closed by a triangular side wall which is perpendicular with respect to the dividing plate 71. A window 76 is provided through each of the inclined surfaces 74, an opening/closing valve 77 being provided at each of the depressions 72 around the perimeter of the rear of the windows 76.

The opening/closing valves 77 are sheet-like and formed from a lightweight material such as rubber, resin, or the like, are dimensionally larger than the windows 76, and have one side fixed to the rear side of the inclined surfaces 74 at the top of each of the windows 76. Therefore, these opening/closing valves 77 are, in the normal condition, pressed across the rear surface of the inclined surfaces 74, thereby closing off each of the windows 76 from the rear.

At a prescribed location on the dividing plate 71 is provided at least one small air ventilation hole 78. In the seventh embodiment, there are air ventilation holes 78 provided in four locations, the total cross-sectional surface area of the four air ventilation holes 78 being approximately equal to the cross-sectional area of the atmospheric port 34 provided on the canister 22 and described previously with regard to FIG. 1. In addition, on the rear side of the dividing plate 71 is provided a cover 80 for the purpose of protecting the opening/closing valves 77 which are mounting to the rear surface of the depressions 72. This cover 80 has provided in it a plurality of air ventilation holes 79.

With a canister 22 having a vapor path dividing valve 70 configured as described above, when there is only a small amount of vapor generated in the fuel tank, air which is obtained by adsorption of fuel vapor which is included in the vapor by the activated charcoal 33 passes through the air ventilation hole 78 which is provided in the dividing plate 71 and is released into the atmosphere from the atmospheric port 34.

When the amount of vapor from the fuel tank is large, so that there is not sufficient release of air from the air ventilation hole 78, the pressure inside the top-side atmospheric chamber 35 of the vapor path dividing valve of the canister 22 rises. When the pressure inside the atmospheric chamber 35 rises, the opening/closing valve 77 is pushed, causing it to be separated from the rear side of the depression 72, as shown by the dotted line in FIG. 17A, so that the window 76 is opened. When this happens, the atmospheric chamber 35 at the top side of the vapor path dividing valve 76 is connected through to the atmosphere via the window 76, so that the air in the atmospheric chamber 35 of the canister 22 is released into the atmosphere via the window 76 and the atmospheric chamber 34, as shown by the dotted line. When the pressure inside the atmospheric chamber 35 becomes low, the weight of the opening/closing valve 77 itself causes it to cover the rear side of the depression 72 once again, thereby closing off the window 76. Therefore, in this embodiment as well, it is possible to limit the pressure inside the fuel tank to a prescribed pressure.

Figure 18:
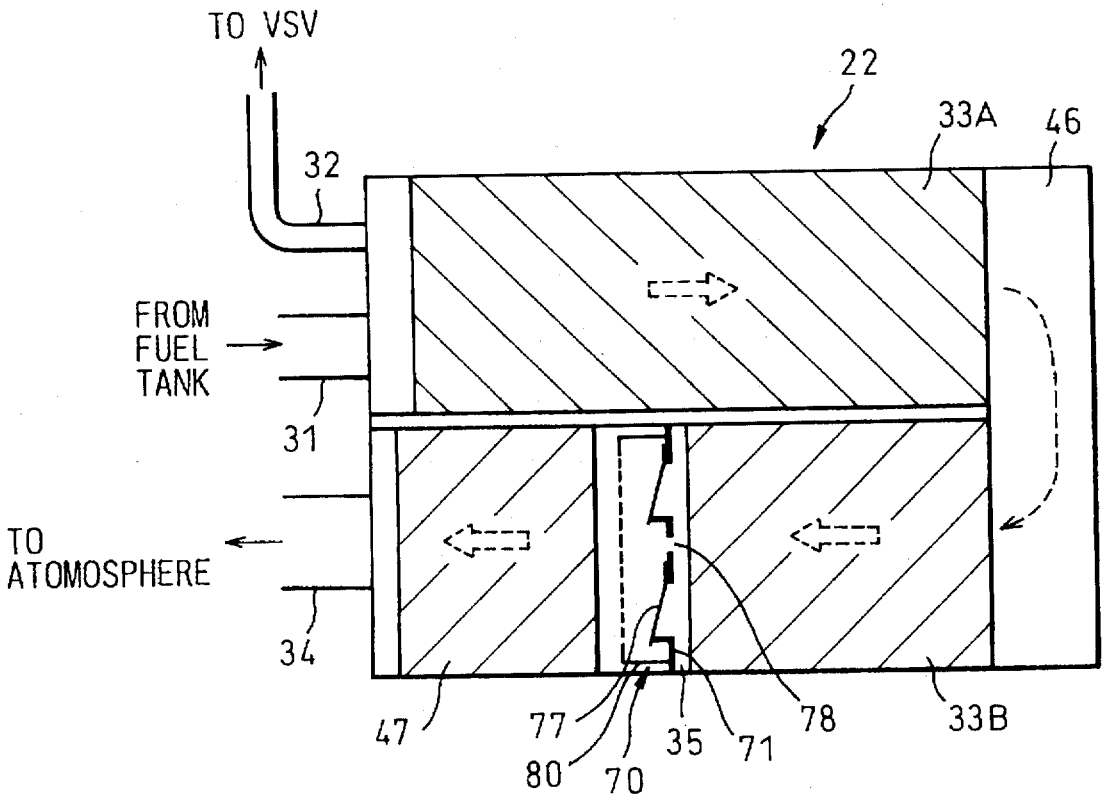
FIG. 18 is a cross-sectional view which shows the construction of the canister of a variation of the seventh embodiment of a fuel-vapor emission-control system for an internal combustion engine according to the present invention.

FIG. 18 is a cross-sectional view of the construction of the canister 22 of a variation of the seventh embodiment of the present invention. In this variation of the seventh embodiment, there are, inside the canister, activated charcoals 33A and 33B which are divided in the canister between top and bottom. On the atmospheric side of the activated charcoal 33A is provided a vapor path dividing valve 70, as described with regard to FIG. 17A and FIG. 17B. A buffer activated charcoal 47 is provided between the vapor path dividing valve 70 and the atmospheric port With the canister 22 of this embodiment variation, with the exception of during refueling, air is released to the atmospheric side via the air ventilation hole 78 in the vapor path dividing valve 70, the buffer activated charcoal 47 serving the function of a buffer canister. Therefore, at the time of a purge, there is priority given to purging from the buffer activated charcoal 47 and the activated charcoal 33B on the atmospheric side, so that a clean condition can be maintained at all times. When vapor is adsorbed, since the only connection between the atmospheric side buffer activated charcoal 47 and the activated charcoal 33B is a small air ventilation hole 78, it is not easy for vapor diffusion to occur. Therefore, even if there is new vapor adsorption, it is possible to prevent release of vapor from the atmospheric port 34.

In addition, when refueling is done, because the vapor pressure opens the opening/closing valve 77 of the vapor path dividing valve 70, so that a vapor path is with a large aperture area is established, vapor which includes a small amount of vaporized fuel flows into the buffer activated charcoal 47 which is always maintained in the clean condition, without allowing the ventilation resistance to increase, thereby releasing only clean air into the atmosphere after adsorption of the fuel vapor. Thus, it is possible to improve the working capacity of the canister 22, even when refueling.

The installation position of the vapor path dividing valve 77 within the canister 22 is established by the capacity of the buffer activated charcoal 47 in terms of blow through performance, and this can be mounted at a convenient location in the canister between the relay chamber 46 and the atmospheric port 34.

What is claimed is:

1. A fuel-vapor emission-control system for an internal combustion engine wherein fuel vapor generated in a fuel tank is adsorbed and, while the engine is running, is subsequently returned to the intake manifold of an engine, said fuel-vapor emission-control system comprising:

refueling detection means for detecting refueling of the fuel tank;

a canister having a housing enclosing adsorbing material for adsorbing vaporized fuel, wherein a tank port, into which fuel vapor flows from the fuel tank, is located at one end of said housing, and wherein the canister includes a purge port from which fuel vapor is exhausted to said intake manifold, and wherein an atmospheric port is located on another end of said housing and is connected to the atmosphere;

an atmospheric release surface area changing mechanism including an electromagnetic valve provided at a prescribed position on said atmospheric port side of said canister for varying the atmospheric release surface area of said canister by varying an opening of the valve so that, when the internal pressure inside said fuel tank is large, the atmospheric release surface area is greater than when the internal pressure inside said tank is small; and control means coupled to the refueling detection means and to the atmospheric release surface area changing mechanism for controlling the degree of opening of the valve so that the degree of opening of the valve is increased when the refueling condition is detected.

2. A fuel-vapor emission-control system according to claim 1, where two atmospheric ports, a first atmospheric port and a second atmospheric port are provided, and further wherein said atmospheric release surface area changing mechanism is provided on said second atmospheric port.

3. A fuel-vapor emission-control system according to claim 1, said fuel-vapor emission-control system further comprising a diaphragm and a diaphragm chamber which is sealed off by said diaphragm, the other end of said second atmospheric port, one end of which is open to the atmosphere, being sealed by said diaphragm when the pressure within said canister is low, said other end of said second atmospheric port being made the diaphragm valve which opens when the pressure within said canister rises, so that said diaphragm moves in the direction towards said diaphragm chamber.

4. A fuel-vapor emission-control system according to claim 3, wherein a buffer canister having a small working capacity and provided with a third atmospheric port is further provided on said first atmospheric port and the atmospheric side of said second atmospheric port.

5. A fuel-vapor emission-control system for an internal combustion engine wherein fuel vapor generated in a fuel tank is adsorbed and, while the engine is running, is subsequently returned to the intake manifold of an engine, said fuel-vapor emission-control system comprising:

a canister having a housing enclosing adsorbing material for adsorbing vaporized fuel, wherein a tank port, into which fuel vapor flows from the fuel tank, is located at one end of said housing, and wherein the canister includes a purge port from which fuel vapor is exhausted to said intake manifold, and wherein an atmospheric port is located on another end of said housing and is connected to the atmosphere; and an atmospheric release surface area changing mechanism including an inclined plate mounted at an inclination with respect to the ground at a prescribed position on said atmospheric port side of said canister for varying the atmospheric release surface area of said canister so that, when the internal pressure inside said fuel tank is large, the atmospheric release surface area is greater than when the internal pressure inside said tank is small, wherein the inclined plate includes an air ventilation hole and a valve body which is supported at one end by a top part of the air ventilation hole and, with its own weight, covers and seals the air ventilation hole when the internal pressure inside the canister is below a predetermined minimum pressure.

6. A fuel-vapor emission-control system according to claim 5, wherein inside the housing of said canister said adsorbing material is disposed in a horizontal line at a prescribed spacing, and wherein said pressure-sensitive valve is disposed in a space between these two adsorbing materials.

7. A fuel-vapor emission-control system according to claim 1 further comprising a buffer canister having a small working capacity, said buffer canister being connected to the atmospheric side of said atmospheric release surface area control valve.

8. A fuel-vapor emission-control system according to claim 1, wherein said atmospheric release surface area changing mechanism further comprises an internal pressure sensor which detects the internal pressure inside said fuel tank, and wherein said control means performs feedback control of said electromagnetic valve in response to a detected value of internal pressure in said fuel tank input from said internal pressure sensor, so that the internal pressure is controlled to a prescribed value and also performs control so that when refueling to said fuel tank is detected the degree of opening of said electromagnetic valve is controlled so that the degree of opening of said electromagnetic valve is another prescribed value.

9. A fuel-vapor emission-control system according to claim 8, wherein the atmospheric release surface area control valve is an electrical purge flow control valve which is controlled by duty cycle control.

10. A fuel-vapor emission-control system according to claim 8, wherein a buffer canister having a small working capacity is connected to the atmospheric side of said atmospheric release surface area control valve.

11. A fuel-vapor emission-control system according to claim 1, wherein said electromagnetic valve is configurated so as to hold a prescribed degree of opening A when it is not electrically energized, and wherein said control means does not electrically energize said electromagnetic valve when said internal combustion engine is stopped while refueling is not being performed.

* * * * *